US006058567A

United States Patent [19]

Roberson

[11] Patent Number: 6,058,567

[45] Date of Patent: May 9, 2000

[54] APPARATUS AND METHODS FOR PURIFYING AND SORTING TEXTILE FIBERS BY LENGTH USING FOCUSED ENERGY FIELDS

[76] Inventor: James H. Roberson, P.O. Box 1311, Clemson, S.C. 29633

[21] Appl. No.: 08/877,044

[22] Filed: Jun. 17, 1997

[51] Int. Cl.[7] ..... D01B 3/04

[52] U.S. Cl. ..... 19/66 R; 19/65 A; 19/200; 19/205; 2009/700; 406/69; 406/109; 406/155

[58] Field of Search ..... 19/65 A, 65 R, 19/66 R, 66 CC, 98, 106 R, 200, 202, 203, 204, 205; 57/408, 409, 411; 209/700, 671, 2, 3.1, 142; 406/1, 69, 70, 109, 155

[56] References Cited

U.S. PATENT DOCUMENTS

| | | | |
|---|---|---|---|
| 3,341,008 | 9/1967 | Mayer, Jr. et al. | 19/200 |
| 4,470,172 | 9/1984 | Leifeld | 19/202 |
| 4,471,607 | 9/1984 | Schmolke | 19/105 |
| 5,186,331 | 2/1993 | Valster | 209/3.1 |
| 5,365,640 | 11/1994 | Sterin | 19/200 |

*Primary Examiner*—John J. Calvert
*Assistant Examiner*—Gary L. Welch
*Attorney, Agent, or Firm*—Cort Flint; Henry S. Jaudon

[57] ABSTRACT

An arrangement for sorting a first category of fibers having a first set of properties into at least a second category of fibers having a second set of properties and a third category of fibers having a third set of properties. The arrangement comprises a sorting channel including at least one travelling teeth laden carrier surface driven in a first direction within the sorting channel. The sorting channel further includes at least a first inlet and at least first and second outlets. A first energy field flows through the sorting channel in a second direction. The first category of fibers are plied to the travelling teeth carried on the driven carrier surface and the first energy field causes at least the longer fibers from the first category to be held latched onto the travelling teeth as it washes and strips away shorter fibers and impurities producing the second category of fibers. As the first energy field exits the sorting channel through the first outlet it also acts as a first doffer for removing the stripped shorter fibers and impurities out of the sorting channel. These non-latched fibers and impurities comprise the third category of fibers. A second doffer is provided for doffing the latched second category of fibers from the travelling teeth after these fibers are carried out of the sorting channel through the second outlet by the travelling teeth.

50 Claims, 18 Drawing Sheets

APPARATUS AND METHODS FOR PURIFYING AND SORTING TEXTILE FIBERS BY LENGTH USING FOCUSED ENERGY FIELDS

BACKGROUND OF THE INVENTION

The present invention is concerned with devices for selectively separating trash particles from textile fibers and for selectively separating/sorting shorter fibers from longer fibers, i.e. converting fiber properties from one category to other categories.

The fibers delivered to textile mills, as raw materials for processing, are usually a mixture of dust, impurities and fibers having varying lengths ranging from long fibers to short fibers. During the initial processing steps of opening, cleaning, and carding, many of the original longer fibers are broken, producing even more short fibers. It is well known that the presence of the shorter fibers and tiny pulverized trash particles seriously and adversely affects the ability to spin "high quality" yarns. For this reason, high quality fine-count cotton mills usually sort their fibers by length before the spinning process. It is almost universally agreed that, today, the most effective way to length-sort fibers on a production scale is by use of reciprocating or oscillating combing machines. Their combs also strip out many of the tiny pulverized trash particles. Conventional combers are the most complicated machines used in any of the spinning processes. Owing in part to their high capital costs, high complexity, and high maintenance costs, and the fact that several extra fiber paralleling processing steps must be added in order for conventional combers to even work satisfactorily, adds from 18% to 40% to the processing costs for "combed" yarns, as compared to plain "carded" yarns. However, in view of the many yarn quality advantages provided by length-sorting, most cotton mills would comb or length-sort today were it not for the tremendous costs involved. There has been a long standing and urgent need for a better way to length-sort and purify textile fibers.

Proof of this long standing and urgent need is found in the fact that there have been a tremendous number of prior art attempts to address this critical problem. For example, U.S. Pat. Nos. 5,365,640, 5,333,358, 4,631,781, 4,471,607, 5,111,551, 3,737,952 4,135,275, 5,241,726, 3,579,744 and 4,064,598, and Gunter Cooke publication "The G.C. 600M-3Ace" 10-1968 are representative of just a few of the many, many past attempts to use toothed rolls or cylinders, rotating at high speeds, in order to create sufficient centrifugal forces to sling the undesirable fibers and other impurities from the desirable fibers carried by the teeth. Some of these devices have added one or more sharp edged devices ("mote knives") which are disposed adjacent to the periphery of the spinning toothed rolls. Mote knives act to enhance the separation of the impurities from the fibers by inertially popping, or stripping, the tightly bound impurities off of the fibers restrained on the moving teeth. Some of these devices have also incorporated suction boxes, suction hoods, or suction slots which are disposed near to the periphery of the spinning toothed rolls in order to further enhance the purification operation by capturing the impurities as they are stripped from the fibers under process, and conveying them away by air currents. This ensures that the dislodged impurities do not become re-entrapped in the fibers from which they were just extracted.

At this point, it is very important to remember that the adhesion/entanglement forces between the longer desirable fibers and the shorter less desirable fibers and the pulverized trash particles are extremely high—because many of the shorter fibers are actually immature fibers having thin under-developed cellular walls and their ribbon-like shapes causes them to wrap tightly and repeatedly around the longer fibers (which are also curled ribbons). Also, viewed under a microscope, the small pulverized trash particles usually look like miniature cockleburrs, having a great affinity to being repeatedly wrapped by the curly and rough surfaces of the longer fiber ribbons. Therefore, a great deal of mechanical work must be done in order to overcome these high entanglement forces. Consequently, the prior art that relies solely on high centrifugal forces to effect purification, is most suitable for extracting only large trash particles. The prior art that relies on a combination of centrifugal forces and "mote knives" to effect purification can extract both large particles and some of the finer particles and shorter fibers. It is well known, however, that when the centrifugal forces rise to the level that small particles and short fibers start to become effectively stripped off of the longer fibers, then the high contact velocity of the fibers striking the sharp "mote knife" edges causes fractures and bruising of the longer desirable fibers. Needless to say, breaking good fibers in order to remove impurities and some shorter fibers is not a very good solution to the problem.

In order to treat the fibers less violently, there also have been a tremendous number of prior art attempts to purify fibers via the use of porous defined wall screens. For example, U.S. Pat. Nos. 4,827,574, 5,327,617, 5,432,980, 4,809,404, 5,031,280, 3,815,178, 4,274,178, 5,303,455, 2,987,779, and 3,145,428 are representative of just a few of the many screen configurations that have been used in a non-impact manner. In addition, U.S. Pat. Nos. 4,519,114, 1,026,432, 1,593,965, 1,458,870, 1,605,196, 1,942,368, 2,025,701, and 5,150,502 are representative of just a few of the many applications where screens have been used either as "condensers", or as "impact" cleaners.

It is well known in the textile arts that whenever fibers are either placed on, or slammed against, porous defined wall screens and air currents flow through the fibrous mass, then a certain small fraction of the impurities contained therein may become dislodged and carried away in the air flowing through the apertures of the screens. However, it is also known that the fraction of impurities dislodged, compared to the total impurities burden present, is woefully small, and screens used in this manner are best suited for "de-dusting" purposes, rather than for removing short fibers longer than about ⅛ inch (4 mm) or jagged small trash particles. There are a number of reasons for this purification inefficiency; one of which is the phenomenon called "felting." "Felting" occurs primarily because the free ends of highly opened fibers poke through the apertures of the screens and tend to get hooked and twisted together, and adjacent non-hooked fibers cling to these because of the natural affinity of curled fibers to interlock tightly with one another. Whenever fibers "felt" on a screen they build a filtering media that traps the trash particles and fiber fragments flowing behind them, and this greatly diminishes the ability of the device to separate these impurities from the fibers being washed by the air currents. In other words, because of "felting," the fibers just previously washed by air currents become re-contaminated by subsequently arriving impurities, and when the longer desirable fibers are transferred from the purification zone they carry these trapped impurities along with them. For these reasons, and others that will become apparent below, none of the above cited prior art is suitable to meet the objects of the present invention.

Accordingly, it is an object of this invention to provide a fiber length-sorting and purification mechanism that carries fibers on teeth travelling in a first direction while working the fibers under process with a HIGH VELOCITY aero-energy field flowing through the teeth in a generally OPPOSITE direction; so that fibers of a preferred longer length can be held latched to the travelling teeth, while shorter length fibers and other impurities are washed, teased, and stripped (aero-combed) off of the latched longer fibers.

Another object of the present invention is to provide a mechanism that can very efficiently, but gently, strip tightly adhering tiny trash particles and short fibers from longer fibers via a carefully focused high velocity aero-energy field, without incurring the brutal fiber damaging effects associated with sharp edged mote knives.

Another object of the present invention is to provide a mechanism that does not require high centrifugal forces in order to accomplish the fiber length-sorting/purification action.

Another object of the present invention is to provide a fiber length-sorting and purification mechanism that does not require the use of electrostatic forces to restrain the fibers during the length-sorting/purification action itself, because the magnitude of electrostatic forces that can be applied to certain types of fibers, particularly hygroscopic types, such as cotton, are small relative to the tremendous stripping forces needed to separate shorter fibers and small jagged impurities from longer fibers with high efficiency. (It is known that electrostatic forces are most effective in controlling non-conductive fibers that can hold a static electric charge on their surfaces, and hygroscopic fibers readily bleed off static electric charges due to moisture absorption from normal production atmospheres.) It is to be understood, of course, that there are certain embodiments of the present invention where electrostatic forces may be advantageously used to manipulate the fibers (low forces situations) either BEFORE or AFTER the actual length-sorting/purification action occurs in the process.

Another object of the present invention is to provide a fiber length-sorting and purification mechanism that does not depend on the use of a porous defined wall screen, or screens, in order to effect the physical or actual separation of longer desirable fibers from the less desirable components. It is to be understood, of course, that there are embodiments of the present invention where screens may be appropriately used as parts of "condensers" in order to separate a group of fibers from a conveying air stream AFTER the group has been length-sorted/purified, because this is a very practical way to use screens.

These and other objects will become apparent below.

SUMMARY OF THE INVENTION

The instant invention is directed to an apparatus for sorting a first category of fibers having a first set of properties into at least a second category of fibers having a second set of properties and a third category of fibers having a third set of properties. The apparatus includes a sorting channel having at least one travelling, teeth laden, carrier surface driven in a first direction within said sorting channel and at least a first inlet and at least first and second outlets. There is a fiber plying device for plying the first category of fibers to the teeth which travel in said first direction. A first energy field is provided and flows through the sorting channel in a second direction. This energy field causes at least the longer fibers, from the first category, to be held latched onto the travelling teeth moving through the sorting channel. Simultaneously the first energy field washes, teases and strips shorter fibers and other impurities away from the teeth and the latched longer fibers. These latched and washed fibers produce a second category of fibers. The first energy field concurrently acts also as a first doffer for transporting unlatched shorter fibers, fragmented fibers, impurities and dust through the first outlet and out of the sorting channel: These fibers and impurities constitute a third category of fibers. A second doffer is provided for doffing the latched or second category of fibers from the travelling teeth after they are carried through the second outlet and out of the sorting channel.

The fiber plying device may include a fiber opener that introduces the opened first category of fibers to the first energy field which subsequently plies the first category of fibers to the travelling teeth in the form of a fog of fibers. Alternatively, the fiber plying device may include a fiber opener for opening and plying the first category of fibers to the travelling teeth via direct mechanical transfer.

The second doffer may comprise teeth carried on a second travelling carrier surface or it may comprise a second energy field travelling in the same direction as the travelling teeth carried on the first travelling carrier surface after it has moved out of the sorting channel.

The flow channel approaching a first inlet of the sorting channel may be angularly oriented relative to the first carrier surface to cause the fibers carried with the first energy field to strike generally non-tangentially to the travelling carrier surface. Such action causes the second category of fibers, which pass through the second outlet, to be comprised of both long and short fibers and causes the third category of fibers, passing through the first outlet, to be comprised substantially of fiber fragments, dust, and trash particles; thereby causing the invention to behave like a novel condenser. Alternatively, the flow channel approaching the first inlet may be angularly oriented such that the first category of fibers pass generally over the periphery of, or generally tangentially to, the travelling carrier surface. This action causes the second category of fibers to be comprised primarily of longer fibers while the third category of fibers comprises primarily shorter fibers, dust, fiber fragments, and trash. Consequently, the invention may be operated also as a novel high-performance fiber sorting device.

The invention may include a plurality of sorting channels, each having travelling teeth laden carrier surfaces, at least a first inlet and at least first and second outlets. The plurality of sorting channels may be sequentially arranged with an inlet of each succeeding sorting channel communicating with an outlet of a preceding sorting channel. Those outlets of the sequentially arranged sorting channels which are not communicating with a preceding inlet communicate with a fiber doffer. With this configuration, the invention may be used to sort the fibers into three or more predetermined categories.

The opener for opening and plying the first category of fibers to the travelling teeth may comprise a carding machine having a carding cylinder. In one arrangement, a doffing channel may be disposed adjacent the carding cylinder. Still another arrangement for the fiber feed comprises a fiber opening device which opens the first category of fibers and a fiber doffer for doffing the first category of fibers from the opening device in the form of a fog of fibers for plying to the travelling teeth.

The fiber doffer may include the first energy field for removing the first category of fibers from the opening device and moving them to the sorting channel.

The sorting channel includes a sorting area or region arranged adjacent that portion of the travelling teeth laden carrier surface where the first energy field works the fibers latched on the travelling teeth.

The travelling teeth laden carrier surface may comprise a carding cylinder of a carding machine, in which case the second doffer may comprise a doffer cylinder clothed with teeth for removing the second category of fibers from the carding cylinder. Alternatively, the second doffer may be comprised of a second energy field which washes the second category of fibers off the teeth of the carding cylinder.

A condenser may be located to communicate with the first outlet for intercepting impurities and short fibers transported with the first energy field after it has doffed these from the sorting channel. Ducting may be associated with the condenser communicating it back with the first inlet. This arrangement allows the first energy field to be reintroduced to the first inlet in a closed-loop or recirculating manner; thereby reducing energy consumption.

The invention includes the method of sorting fibers of a first category comprising fibers of various lengths, dust, and impurities into at least second and third categories. The method includes driving a teeth laden carrier surface in a first direction through a sorting channel having an inlet and at least a first outlet and a second outlet. The method includes creating an energy field and directing that energy field to flow through the sorting channel in a second direction generally opposite to the first direction so that longer fibers of the first category of fibers plied to the travelling teeth can be held latched onto the teeth while fibers of shorter lengths, dust and impurities are doffed out of the sorting channel by the energy field through a first outlet to produce a third category of fibers. The method further includes moving the latched longer fibers through the second outlet to produce a second category of fibers which are then doffed from the travelling teeth.

The method may include generating a fog of fibers of the first category for plying them to the travelling teeth carried by the carrier surface. And, the method may further include angularly orienting the channel approaching the first inlet to cause the fibers in the fog to strike against the moving surface so that both longer and shorter fibers become latched onto the travelling teeth and produce the second category of fibers; leaving the third category of fibers to be comprised of primarily fiber fragments, dust, and other impurities.

DESCRIPTION OF THE DRAWINGS

FIG. 8' shows a plurality of sorting modules arranged in both an alternating and an offset manner to provide a zig-zag flow path for the fibers being sorted.

FIG. 10' shows an alternative arrangement of the sorting and cleaning device of FIGS. 9 and 10 in which yet another arrangement of the infeed channel approaching the first inlet of a sorting channel pivot is shown.

DESCRIPTION OF A PREFERRED EMBODIMENT

Figure 1:
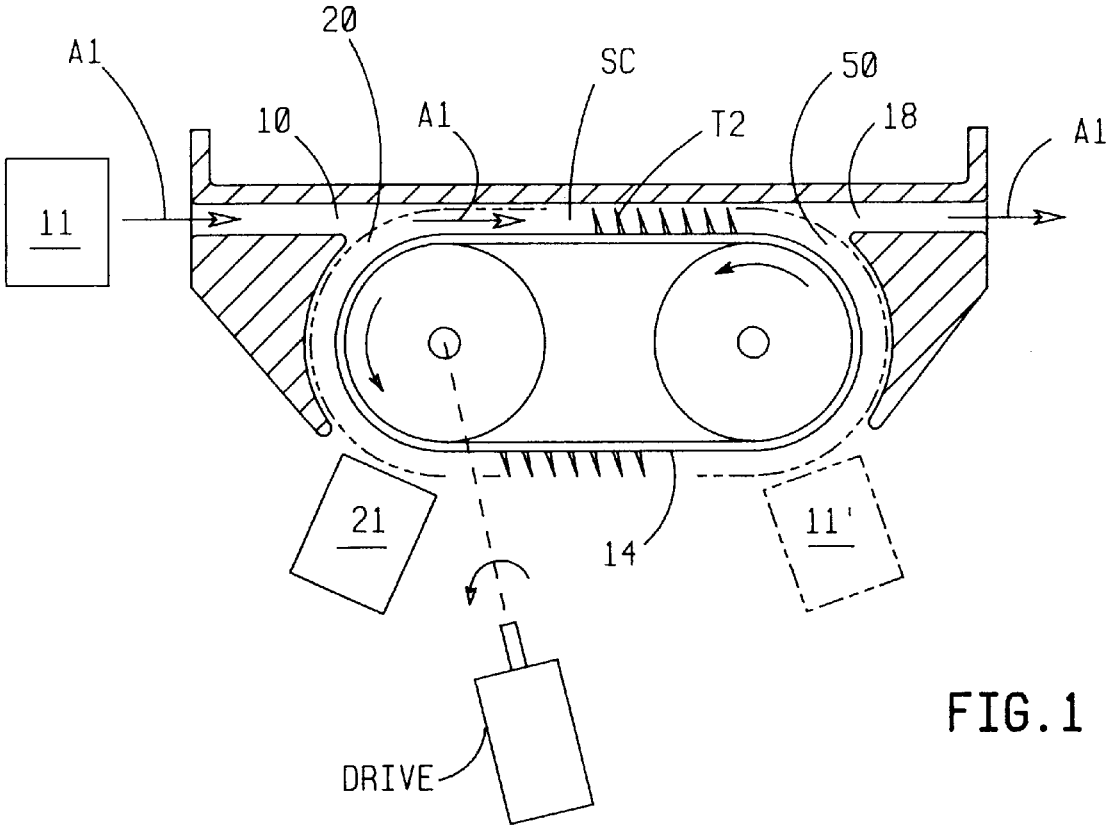
FIG. 1 is a diagrammatic sectional side view of a generalized embodiment of a fiber sorting and cleaning device in accordance with the invention.

Referring now to the drawings, the invention will be described in more detail. Referring first to FIG. 1, the fiber purifying and sorting device shown therein includes a sorting channel SC which has a first inlet 10 through which a first energy field, usually a high velocity stream of air, is induced to flow through the sorting channel SC in the direction of the three arrows A1. The sorting channel also includes a first outlet 18 through which the first energy field exits and a second outlet 20 through which fibers may be extracted from the sorting channel. One surface area or wall of sorting channel SC is defined by a surface of carrier 14 which carries on its outer surface a plurality of teeth T2 which project into the sorting channel. The term "teeth", as used herein, is to be broadly interpreted and understood to mean any of the known ways of providing a plurality of projections into space from a surface which are capable of engaging, hooking, or snagging fibers. Carrier 14 is mounted to and within a suitable frame (not shown) and driven by any suitable means so that teeth T2 travel through sorting channel SC in a direction generally opposite to arrow A1.

In operation, fibers (natural, synthetic or a blend) may be plied to teeth T2 several ways. First the fibers may be highly opened or separated by an opener 11 and carried through first inlet 10 into sorting channel SC in the form of a fog of fibers transported in the first energy field. At this point, the fibers may include long fibers, short fibers, intermediate fibers, dust and trash. This combination is hereinafter referred to as the first category of fibers. As the energy field moves the first category of fibers through the sorting channel in the direction of the arrow A1, teeth T2 are moving in the opposite direction through the channel. The longer fibers of the first category of fibers normally engage with teeth T2 and are caused to be draped about or latched onto the teeth by the dragging forces of the first energy field. The remaining shorter fibers, dust and trash normally either fail to engage or be latched onto the teeth, or are stripped off of the longer fibers which did become latched, and these unlatched particles are carried through the sorting channel and out through first outlet 18 by the first energy field. These unlatched fibers, dust and trash constitute a third category of fibers, and the first energy field acts as a first doffer device; to remove them from the sorting channel.

The longer fibers which were caught or latched onto teeth T2 are carried through second outlet 20 where they are subsequently engaged by a suitable second doffer indicated at 21 and removed from the teeth of carrier 14. These fibers constitute a second category of fibers.

Alternatively, fibers of the first category may be plied to travelling teeth T2 by a mechanical plying device shown in broken lines at 11'. In this instance, the fibers impaled on teeth T2 are pulled into sorting channel SC through a second inlet 50. As these first category of fibers are dragged back against the first energy field, the shorter length fibers, dust, and trashes are washed and stripped free from the longer fibers, which are held tightly latched onto teeth T2. These unlatched impurities are carried out through outlet 18 by the first energy field; thereby producing the third category of fibers. The longer fibers from the first category which were held latched onto the travelling teeth T2 by the dragging forces of the first energy field pass though the second outlet 20, and are subsequently doffed by second doffer 21 as second category fibers.

The teeth on the carrier are normally slanted in a direction opposite the direction of the arrow A1, however, this condition is not necessarily so and the teeth could be configured perpendicular to surface 14. The number of teeth per unit surface area (surface density) and the size of teeth may vary depending upon the desired end-product to be produced and the raw-product being cleaned and sorted. It is preferred that the teeth have a projecting length from the carrier surface of between 1/32 inch (0.79 mm) and 1 inch (25.4 mm) and are arranged with a density of between ½ tooth and 245 teeth per square inch (6.5 square cm). The selected length and density is in part determined by the surface speed of the travelling carrier surface, which preferably is between 23 feet (7 meters) per minute and 6,900 feet (2,103 meters) per minute.

Likewise, the velocity of the first energy field and the production rate affect the desired tooth size and density. Another determining factor is the manner of plying the fibers onto the teeth. Consequently, a little experimentation is normally necessary to define the optimum operating values because of the very large number of variables involved.

In FIG. 1, carrier 14 is illustrated as a belt running around a pair of pulleys. However, those skilled in the art will readily appreciate that there are many applications where a simple spinning cylinder clothed about its surface with teeth may be substituted for a running belt. The advantages of a belt design are: it permits a longer "residence" or working time for the energy field to work and wash the shorter fibers and trashes away from the longer fibers latched onto the travelling teeth. Also, working the fibers along a linear path with the energy field eliminates centrifugal forces while the sorting/purifying takes place. Of course, an advantage of a cylindrical carrier is lower manufacturing costs of the equipment. Therefore, the construction to be used is governed by the needs of the particular application.

There are several ways to ply the first category of fibers to the travelling teeth, and several ways to doff the second category of fibers off the travelling teeth subsequent to the physical sorting operation. Some of these various arrangements will be described below. However, for the sake of brevity, only a cylinder carrier design will be illustrated. Likewise, a plurality of sorting and purifying devices may be used in combination, but only a couple of especially instructive arrangements will be discussed in detail.

Figure 2:
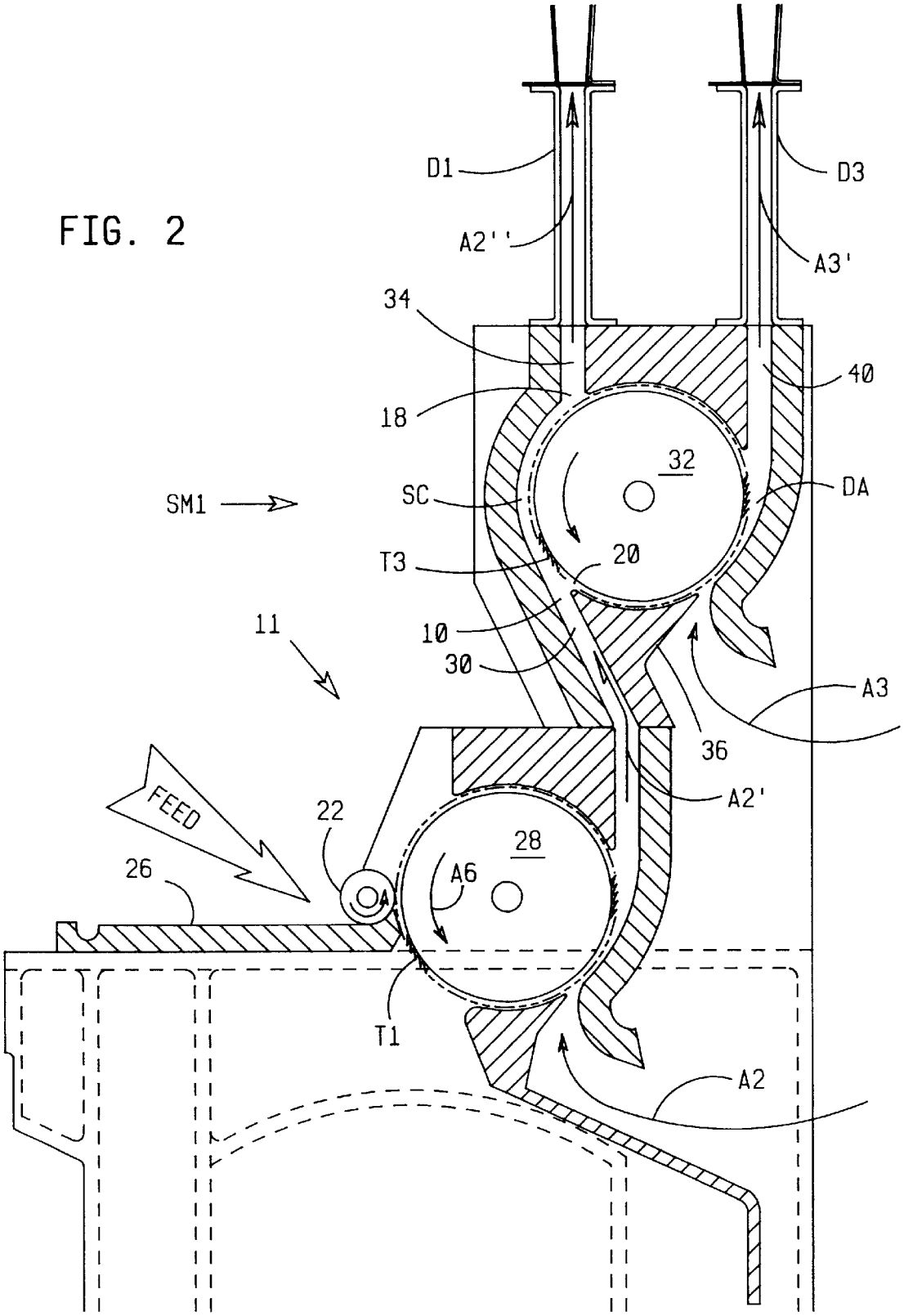
FIG. 2 is an enlarged diagrammatic sectional side view of a more specific embodiment of a sorting and cleaning device including a fiber opening device.
Figure 3:
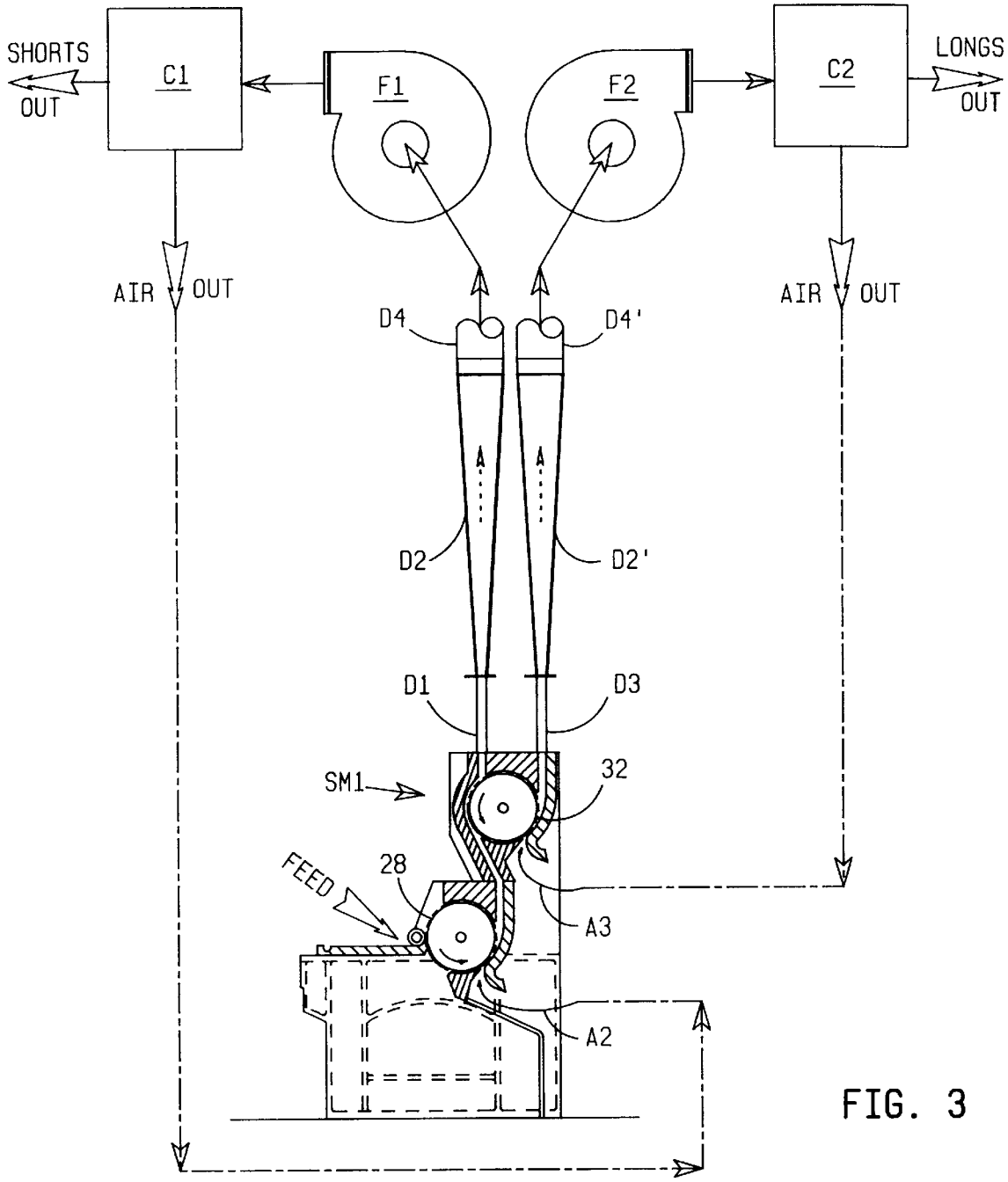
FIG. 3 is an overall system schematic for the arrangement shown in FIG. 2.
Figure 4:
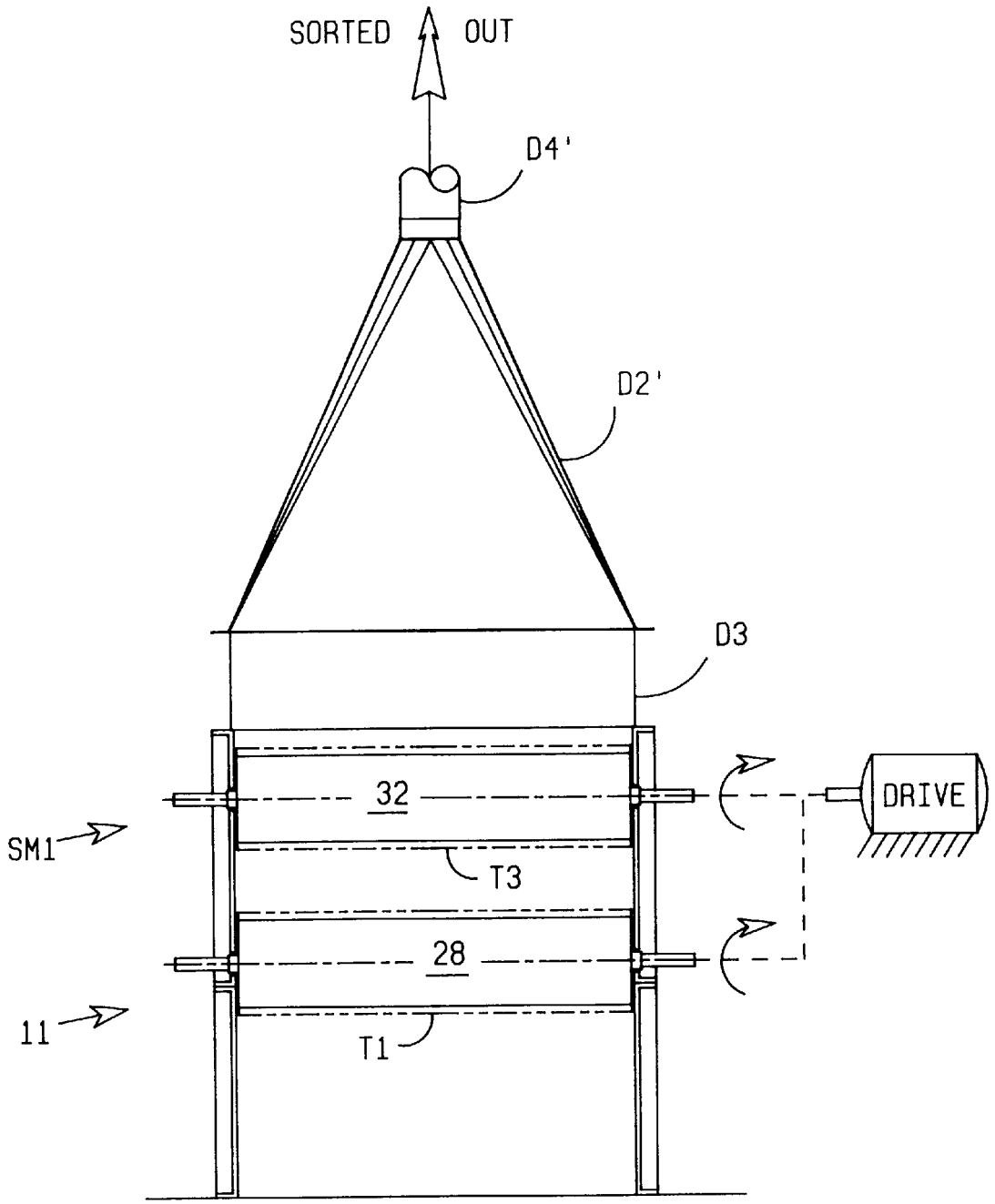
FIG. 4 is a diagrammatic sectional frontal view of the arrangement shown in FIGS. 2 and 3.

Turning now to FIGS. 2–4, a second arrangement of the invention is shown. A fiber plying device comprised of at least one feed roll 22 and a cooperating second nipping member, shown here as a feed plate 26 (but it could be another feed roll), presents fibers of the first category to the teeth T1 of a fiber opening cylinder 28. These teeth, impale, shred, and carry the shredded fibers in the direction indicated by arrow A6 and introduces them to a high velocity air stream or first energy field, which is shown entering a doffing duct in the direction of arrow A2. Because the tips of teeth T1 are moving in the same direction as the first energy field at this location, the shredded fibers are easily doffed from the teeth of cylinder 28, and carried away in the form of a fog of fibers which are aero-suspended in the energy field. It is important to note that this method of using a high velocity energy field—particularly of the velocity magnitude contemplated for the present invention—is widely used in the textile industry to doff fibers from travelling teeth. See, for example, the doffing roll 22 used in U.S. Pat. No. 3,341,008.

The fog of fibers is carried in a feed channel 30 in the direction indicated by the arrow A2' into sorting channel SC of sorting module SM1. Teeth T3, which are carried by cylinder 32, which is travelling in a direction opposite to the flow direction of the energy field, extend into sorting channel SC. As the fog of highly individualized fibers passes through the sorting channel, the fibers careen and bounce off teeth T3. Some of the longer fibers are eventually struck near their middle region, by individual teeth and become folded or draped around the tooth so that the two free ends of the snagged fiber are pointed in the flow direction A2' of the energy field. Having about equal lengths, the bombardment of high speed air molecules of the energy field creates approximately the same dragging force on each of the free ends and the fibers become firmly latched onto the teeth. When a longer fiber is struck by a tooth in an area not near the fiber's middle region the dragging forces of the energy field are greater on the longer projecting end which may cause that fiber to be stripped off and to flow on down stream until it is struck finally by another tooth in a suitable position along its length. Eventually an equilibrium of dragging forces is established and the fiber becomes firmly latched on to this latter tooth. In the manner just described, a beard of folded or draped longer fibers, is formed on the teeth T3 of the fiber sorting cylinder 32 of sorting module SM1.

For some inexplicable reason, individualized shorter length fibers do not seem to exhibit the same propensity to become draped about the teeth T3, and these shorter fibers are carried through the fiber sorting channel SC exiting through a first outlet channel 34 in the direction indicated by arrow A2". The tiny trash particles attached to the free ends of the latched longer fibers and the shorter fibers that may be entwined thereto are bombarded by the air molecules of the energy field and stripped from the latched longer fibers. These impurities likewise exit through the outlet channel 34 in the direction indicated by arrow A2". These shorter fibers and impurities constitute a third category of fibers.

The purified/sorted longer fibers latched onto teeth T3 constitute a second category of fibers, and these are pulled through second outlet 20, past the radiused face of shoe member 36, and into a doffing area or region DA. Here the fibers are doffed from the teeth of cylinder 32.

The shown arrangement of doffing the second category fibers off the teeth T3 is via a second energy field entering along the path indicated by arrow A3, through doffing area DA, and out a channel 40. The second energy field washes the fibers off teeth T3 and carries them along the exit path indicated by arrow A3'. This action is similar to that which created the fog of fibers as they were removed from teeth T1 of cylinder 28, as discussed previously.

It is interesting to note, at this point, that in conventional reciprocating combers the beard of longer fibers is latched or held by a nipper mechanism, while the moving teeth of combs pass through the beard and travel in the direction of the projecting free ends of the latched fibers in order to strip the short fibers off of these free ends. In present invention, the teeth travel in a reversed direction to the projecting free ends of the latched beard and the short fiber stripping, or combing, is performed by the energy field. In other words, in the present invention the moving teeth are used to restrain or hold the beard rather than to comb it. This is a reversal of functions.

FIG. 3 shows the described device of FIG. 2 arranged as a part of a system which includes two fans F1 and F2 which may be used to create the energy fields. Two condensers C1 and C2 are shown separating the third and second category of fibers carried by their respective transporting air streams which flow through flow modifying ducts D1 and D3, respectively.

FIGS. 3 and 4 illustrate how flow modifying ducts D1,D3 may be used to space diffuser transition ducts D2,D2' a substantial "pressure balancing" distance from rectangular shaped outlet channels 34 and 40; through which the energy fields pass the fibers from the sorting module SM1. Ducts D1 and D3—which are narrow in one dimension but wide in a perpendicular dimension and have a generally rectangular cross-section—are interposed between ducts D2, D2' and sorting module SM1 to cause the energy fields to exhibit generally two-dimensional flow characteristics while in and leaving the zone of fiber sorting or combing. Three-dimensional flows having substantial transverse velocity vectors should be avoided in the sorting channel as these can adversely detach latched longer fibers from teeth T3 and thereby decrease the length-sorting efficiency.

It is well known that generally circular ducts of relatively small diameter such as illustrated at D4,D4' in FIGS. 3 and 4 tend to cause three-dimensional flows; particularly when connected to the inlets of fans that use rotating impellers. These flows have a tendency to spread along flow channels for substantial distances. Should circular ducting such as shown at D4,D4' be connected near to the outlets of channels like 34 or 40, three dimensional flows could be backed into the sorting channel and doffing area and act to adversely affect the sorting and doffing actions.

Referring again to FIG. 3, the pair of dash-dot-dash lines (from condensers C1, C2 to arrows A2, A3) schematically illustrate how by suitable piping the conveying air flows comprising the energy fields may be recirculated in order to minimize system energy consumption. The second and third categories of fibers leave the condensers as shown.

It has been found that the more evenly distributed or dispersed the individual fibers are in the fiber fog, the higher the sorting/combing efficiency of the present invention. It has been further found that the more intensely the raw fibers are shredded, opened, separated, loosened or individualized before they are introduced to the energy field, the better the sorting/combing results will be.

Figure 5:
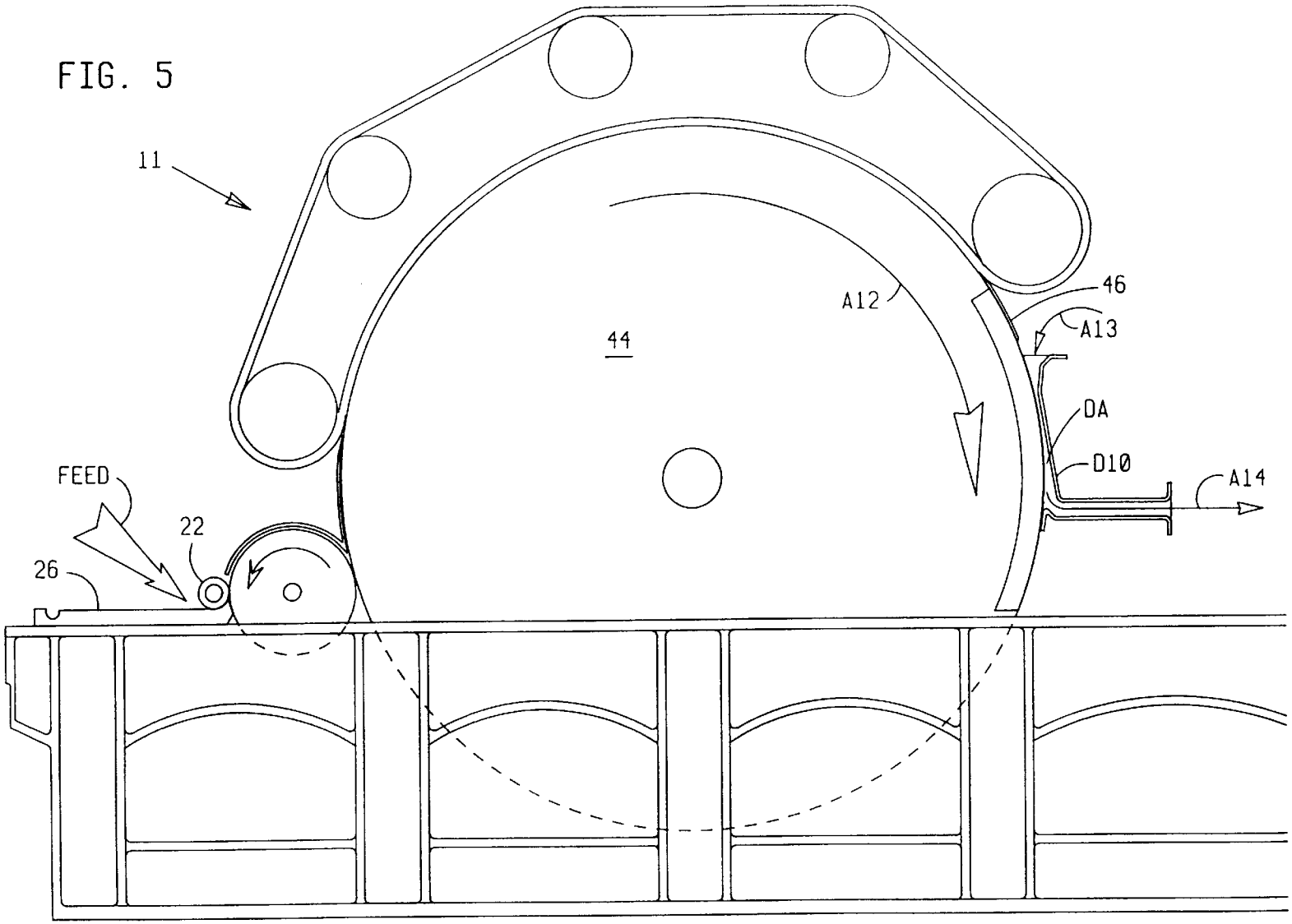
FIG. 5 is a diagrammatic sectional side view of an alternative feed comprising a carding machine utilized as a fiber opening device for communicating with sorting and cleaning devices such as shown in FIGS. 1, 2, 6, etc.

It is well known in the textile industry that conventional carding machines can be used to produce fibers loosened or separated into an almost fiber-to-fiber state. Accordingly, the arrangement shown in FIG. 5 depicts how the principal members of a conventional carding machine, shown generally at 11, may function as a fiber opening device which is particularly well suited for sorting/combing at high production rates. As main cylinder 44 is driven in the direction of the arrow A12, the approximately one million tiny teeth disposed around its surface carry highly individualized fibers. After these fibers pass upper front control plate 46, they are introduced to an energy field shown entering doffing channel D10 in the direction of arrow A13. The energy field moves through doffing area DA and readily doffs the fibers from the teeth of cylinder 44. This doffing action creates a superb fog of fibers for length-sorting and purification. The fiber fog follows the path indicated by arrow A14, and is suitable for injection to various sorting channel inlets 10 (see FIG. 1 or FIG. 2) or other sorting channel inlets to be described below.

Figure 6:
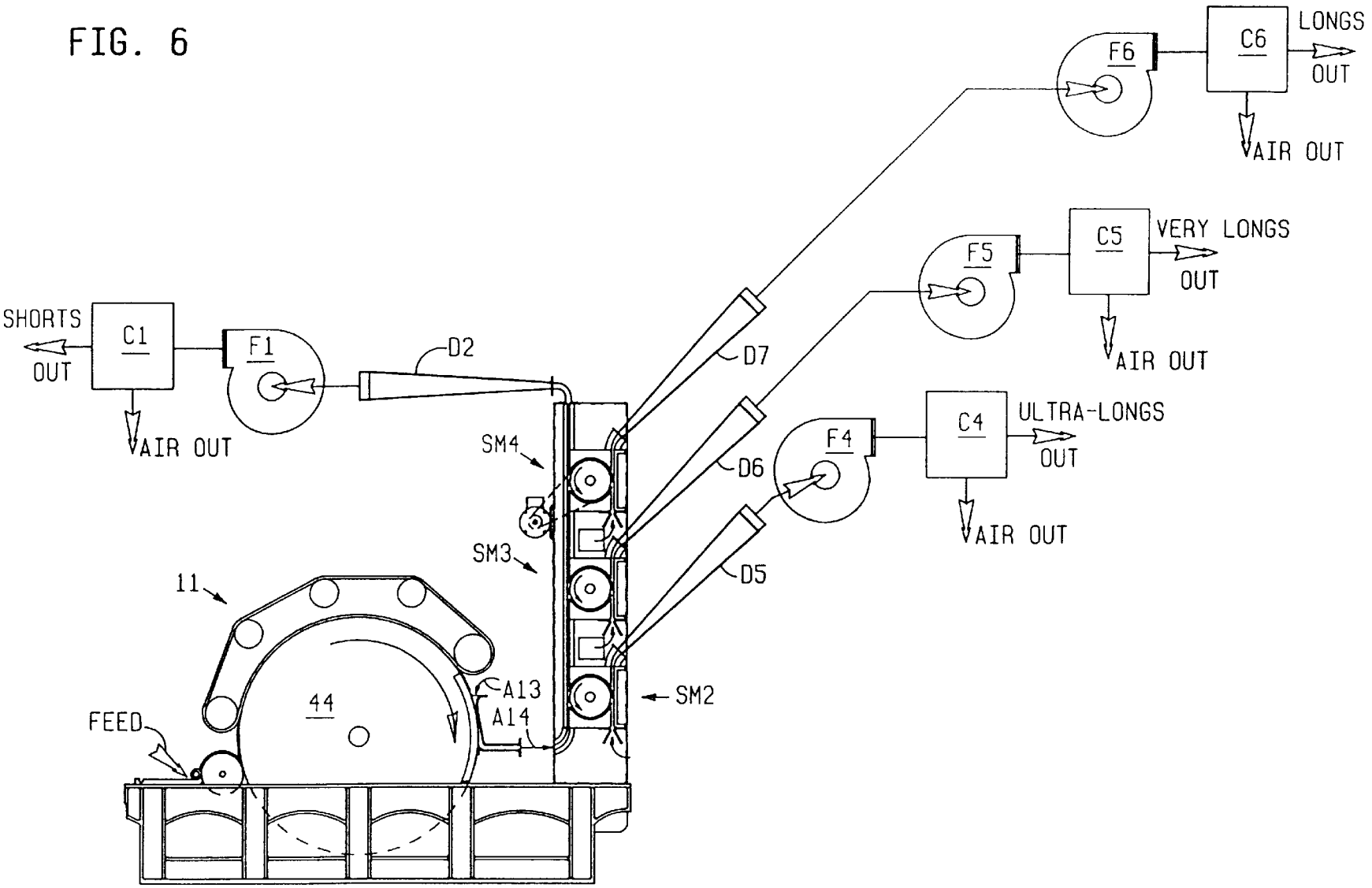
FIG. 6 is a diagrammatic sectional side view of the carding machine of FIG. 5 communicating with a plurality of sorting and cleaning devices in accordance with the present invention.
Figure 7:
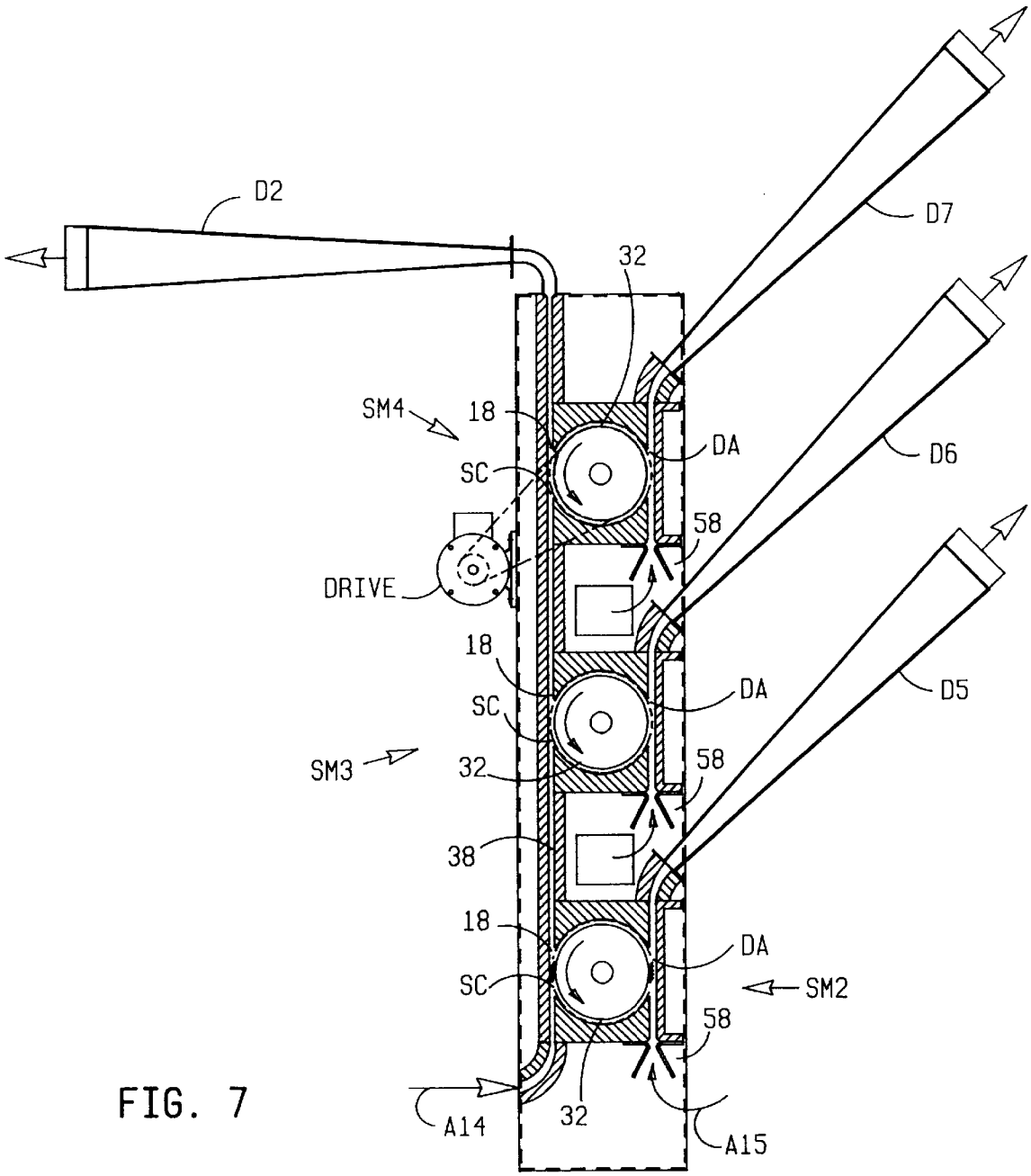
FIG. 7 is an enlarged view of a portion of FIG. 6.
Figure 8:
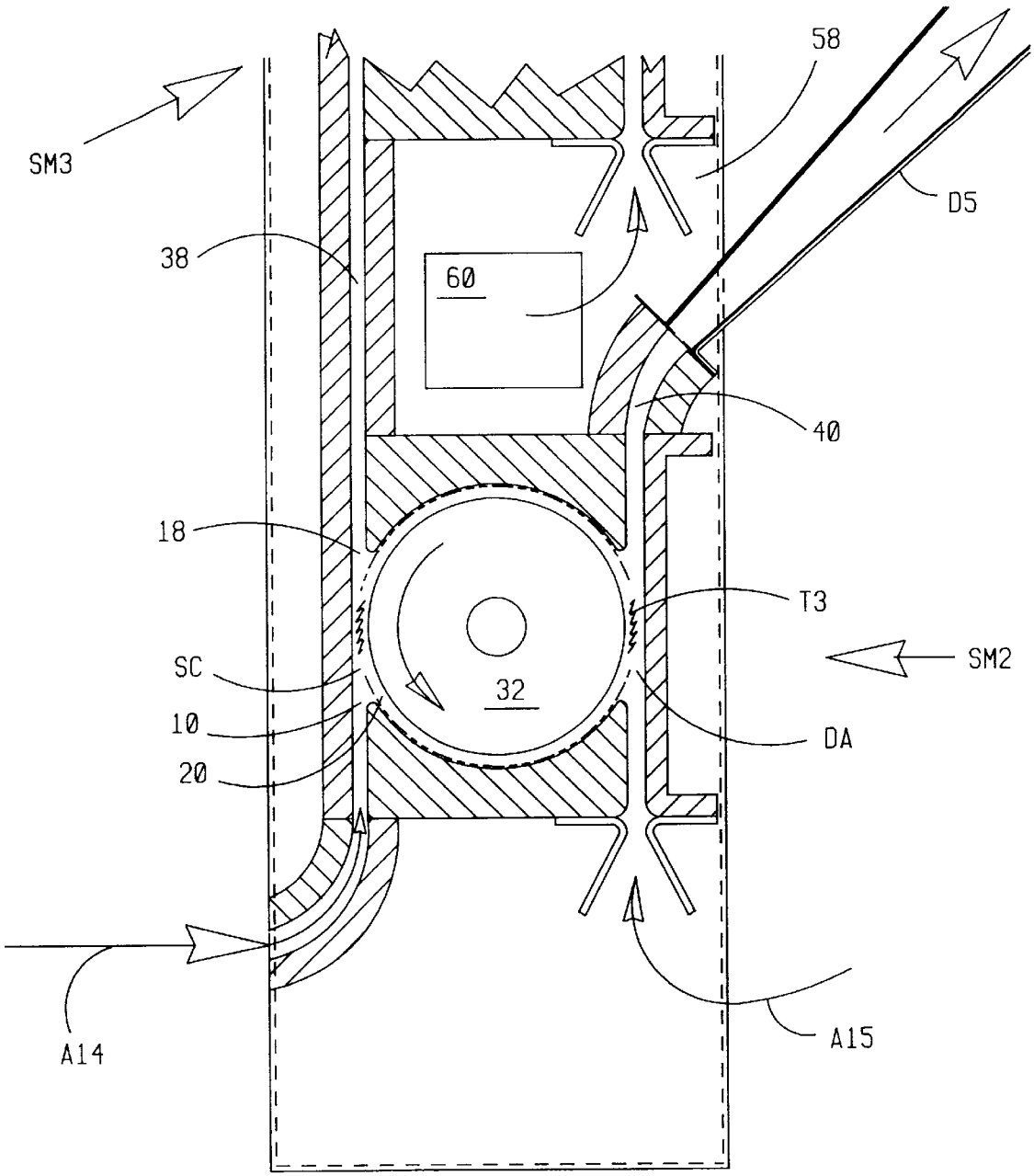
FIG. 8 is a further enlarged view of a portion of FIGS. 6 and 7, showing one of the plurality of sorting and cleaning modules in greater detail.
Figure 8:
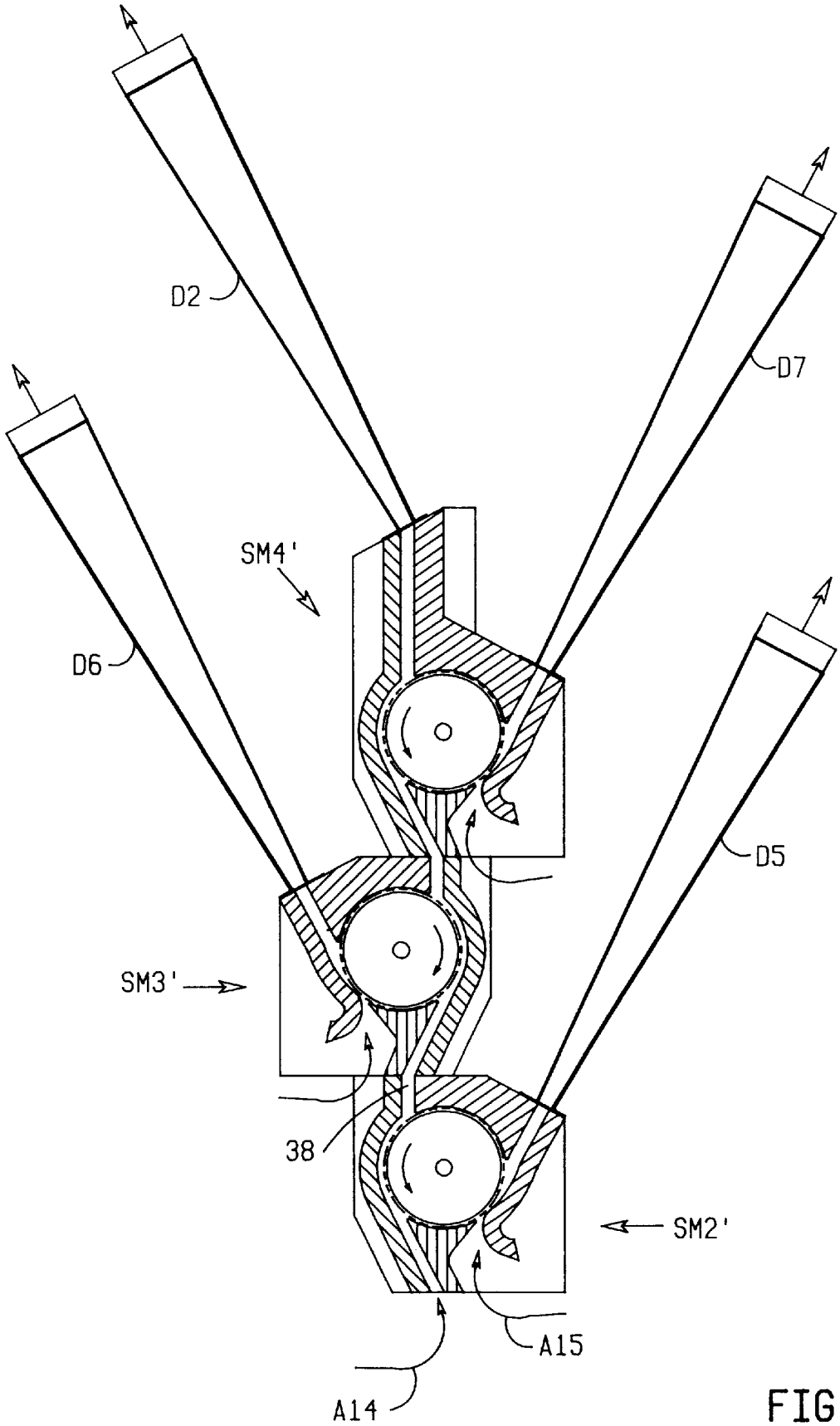

Turning now to FIGS. 6–8 there is shown an alternative arrangement for the device of FIG. 2.

FIG. 6 illustrates the opening arrangement of FIG. 5 delivering a fog of fibers, along the path depicted by arrow A14, to a plurality of fiber sorting modules SM2, SM3, SM4 (more, or fewer modules, are possible) working in combination. A single fiber feed and sorting channel 38 (see FIGS. 7 and 8) interconnects successively with each module and defines the path along which the fog of fibers entering as in the direction of arrow A14 is conveyed through successive sorting channels SC. The teeth T3, which are carried on the surfaces of the several cylinders 32, act to sequentially comb and sort the fibers of the fog as it is continuously moved through sorting channel 38 by the energy field. This arrangement permits some longer length fibers to be selectively extracted from the fog at each successive stage by successive modules SM 2, 3, 4.

Each of the several cylinders 32 may driven independently of the others, thereby allowing varying separating and sorting action at each station as the fiber fog progresses through the successive modules. Each module SM2, SM3 and SM4 includes a second outlet 20 which ultimately communicates with condensers C4, C5 and C6, respectively; following paths (shown by ducts) D5, D6 and D7. Fans F4, F5 and F6 provide the respective second energy fields.

Between modules SM2 and SM3; SM3 and SM4; are arranged separating cabinets 58 which carry air ports 60 for supplying the respective second energy fields. Each module SM 2, 3 and 4 includes an outlet channel 40 which is connected with a respective fiber path D5, D6 and D7. The second energy fields moving in the directions indicated by the arrow at the ports 60 and also arrow A15 act to doff the latched longer fibers from the respective teeth T3, at the respective several doffing areas DA of each module.

With the construction just described, it has been found that by selecting the appropriate number of teeth per unit surface area carried on each of the several fiber sorting cylinders (carriers) 32 (lower teeth density causes less vigorous combing which results in fewer longer fibers being selected from the fog), and by selecting the appropriate speed at which each of the cylinders is rotated (slower speeds, but above the critical speed in which fiber felting on the teeth becomes pronounced, allows increased residence time for air washing and hence enhanced short fiber stripping by the energy field) variable and desired properties may be obtained for each of the second category fibers. These characteristics make it possible to selectively sort/comb the fog such that the longest mean length fibers are separated along the path D5. The next longest mean length fibers may be separated along path D6 and, the next longest mean length fibers flow along path D7. As a consequence, the very shortest mean length fibers along with the trash are finally left to be moved along path D2.

In FIG. 6, four fans F1, F4, F5, F6 and four condensers C1, C4, C5, C6 are shown defining the final paths of four different mean length fiber categories. It will be understood by those skilled in the art, and depending on the object, the three longest fiber categories may be combined again as desired to make a long fiber product of the three longer categories or of any combination of the three. The very shortest fiber category travelling along path D2 is normally removed from the three longer categories. The group of fans F4–F6 may be manifolded together and served by a single common fan and single common condenser depending on the end object. The air stream blending of the three longer lengths provides a good mixture for further processing. In a similar manner, other combinations of length categories are possible.

FIG. 8' illustrates how a plurality of sorting modules SM2'–SM4' (performing comparable functions as SM2–SM4) may be stacked in both an alternating and an offset manner. This arrangement provides that the common flow channel 38, for the fiber fog, follows a tortuous path. With sufficient offset for each sorting module, the fibers in the flowing fog are caused to follow a serpentine path through the stack of sorting modules. Either alternating stacking, or offset stacking provides enhanced exposure of the fibers—in the fog—to the travelling teeth of the several sorting modules.

In most of the arrangements of the present invention described thus far, the second category fibers carried from the sorting channel on the travelling teeth have been doffed from those teeth using a second energy field. However, it has been found with the present invention that these second category fibers may also be doffed mechanically from the travelling teeth using other moving surfaces that are likewise clothed with teeth; with very beneficial results.

Figure 9:
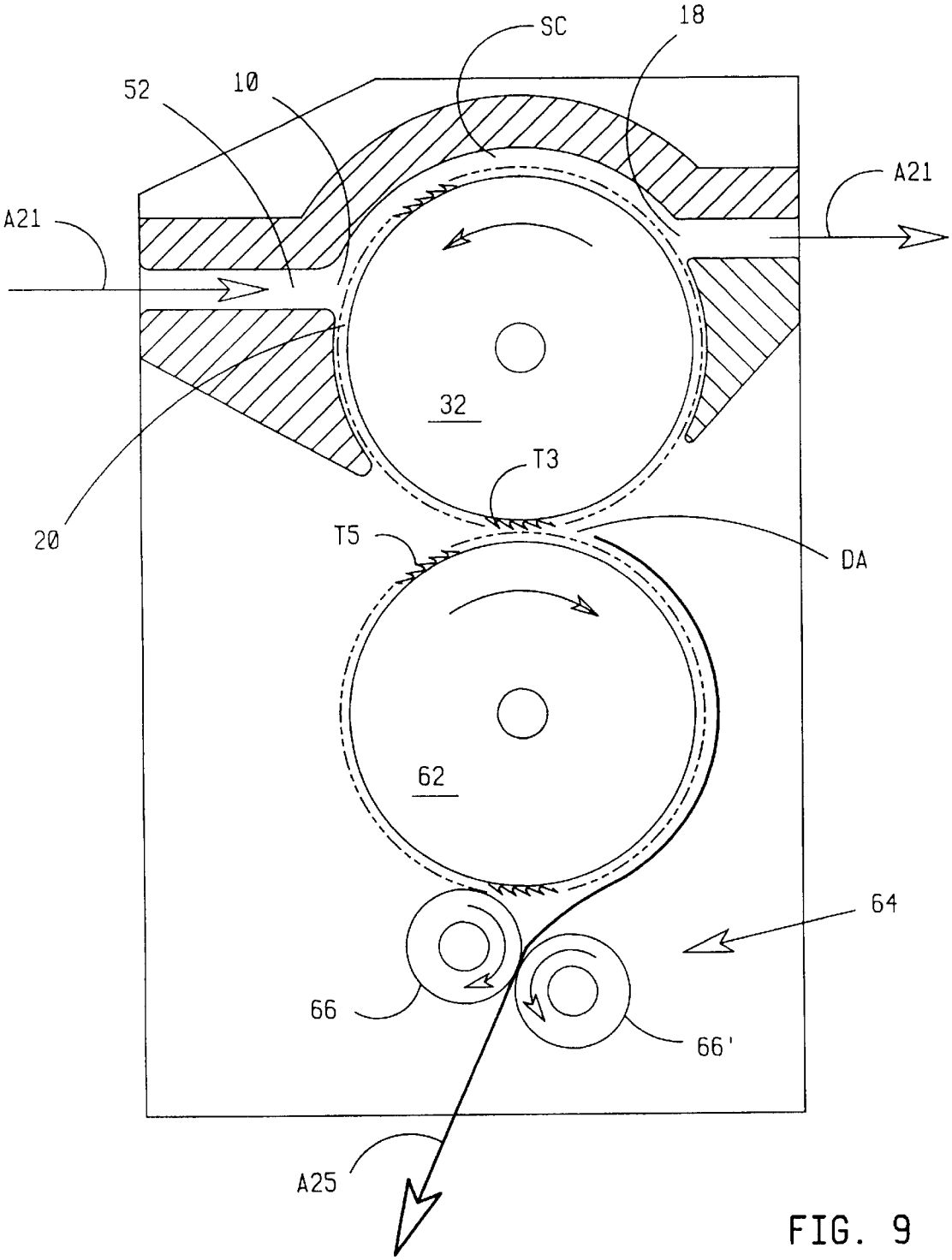
FIG. 9 is a diagrammatic sectional side view of yet another embodiment of the sorting and cleaning device according to the invention.

An example of such a mechanical doffing arrangement is shown in FIG. 9. By closely setting a narrow gap of between 0.004 to 0.005 inches, or about 0.11 mm between teeth T3 and T5, and by directionally pointing these teeth relative to each other as illustrated, and by driving them relative to each other in the directions as illustrated by the arrows, with teeth T5 being controlled to move at a SLOWER tip speed than the tip speed of teeth T3, teeth T5 will remove the fibers deposited thereon. This doffing arrangement is commonly used in carding machines when stripping a conventional main carding cylinder. Likewise, in a well known and understood manner, the thin deposited web carried by doffing roll 62 may be stripped or removed by any of several known stripping mechanisms illustrated schematically at 64 as a pair of peeler rolls 66 and 66'. Thus, the longer fibers originally transported in the energy field, flowing in the direction indicated by arrow A21 (on the left) may be sorted from the shorter fibers and delivered from cylinder 32 in the form of a thin web to subsequent textile processing operations along the path line indicated by arrow A25. The shorter fibers left in the energy field exit the fiber sorting module through first outlet 18 as indicated by arrow A21 (on the right). The shorter fibers may be subsequently removed from the energy field by condensers, such as C1 described previously with references to FIGS. 3 & 6.

Figure 10:
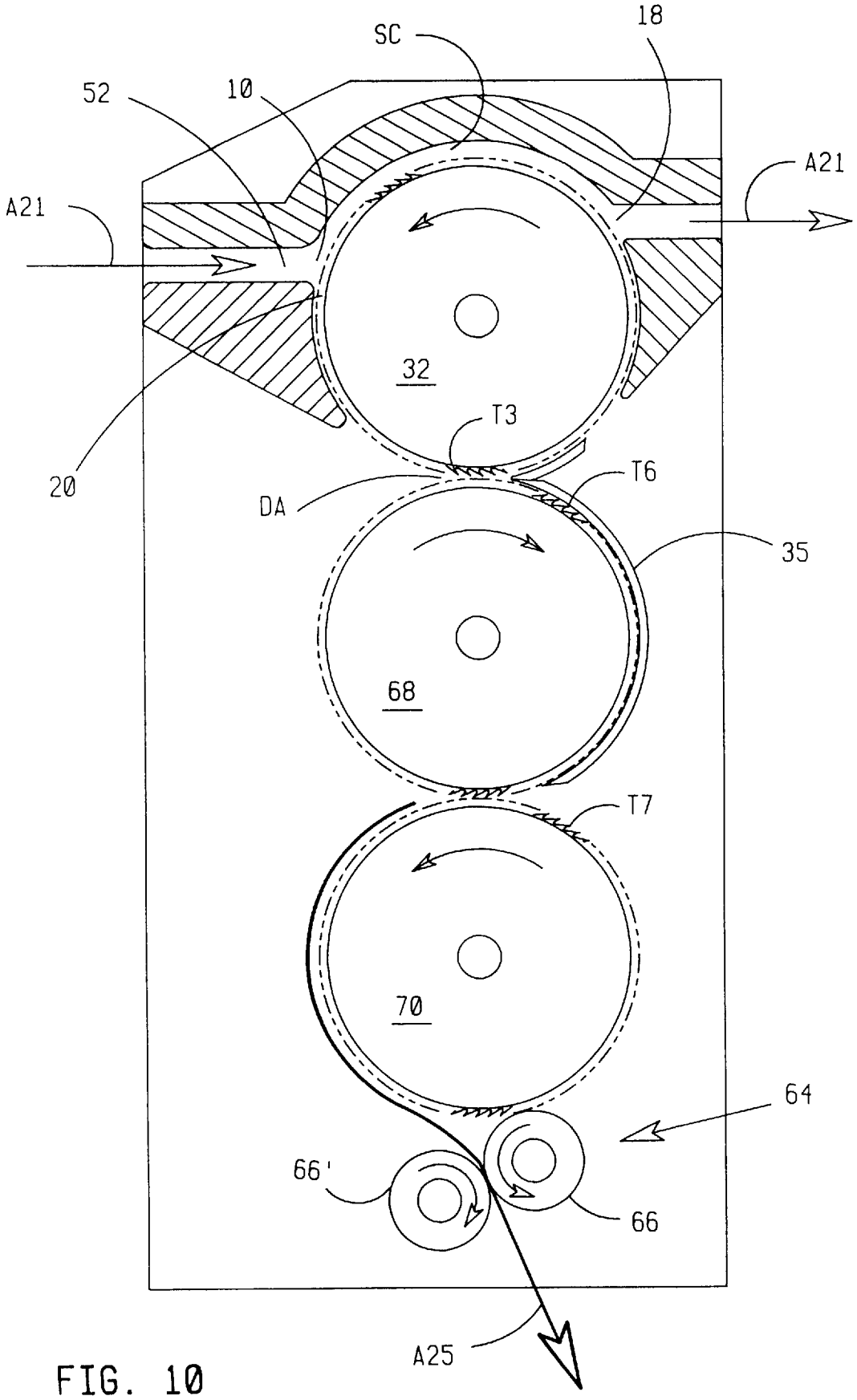
FIG. 10 is a diagrammatic sectional side view of the sorting and cleaning device of FIG. 9 operating with yet another arrangement of a doffing device according to the invention.
Figure 10:
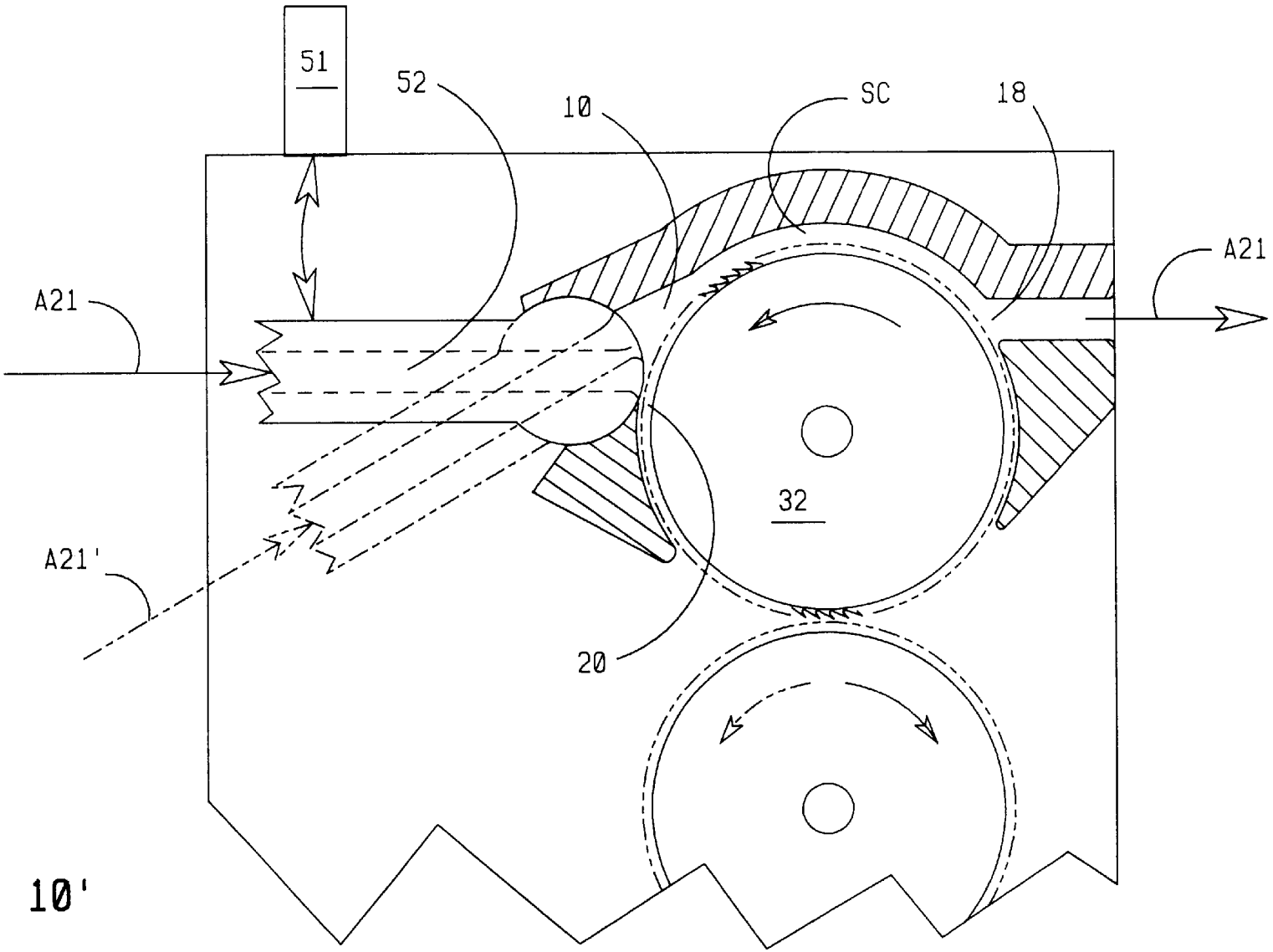

Referring now to FIG. 10, there is shown another mechanical arrangement for doffing the sorted longer fibers from teeth T3. A transfer cylinder 68, having teeth T6 is directionally oriented with cylinder 32 and teeth T3 as shown by the arrows. Teeth T6 are tightly gaped relative to teeth T3, and are driven at a HIGHER tooth tip speed. This will strip the fibers from teeth T3 and transfer them to teeth T6. These fibers are subsequently moved into contact with teeth T7 which doffs them in the form of a thin web. The thin web is striped from roll 70 by stripping mechanism 64 whose rolls 66, 66' convey the web along the path indicated by arrow A25. A control plate 35 may be disposed in close proximity to the tips of teeth T6 to control the fibers against centrifugal forces during web formation. Each of the above fiber transfer actions are likewise well known in the carding machine art with the transfer roll 68 acting like a main carding cylinder stripping a conventional licker-in cylinder. Another novel feature of the arrangements shown in FIGS. 9 & 10 is the angular orientation of the flow channel 52 (leading to inlet 10) relative to the surface of the carrier or cylinder 32. With the orientation shown, the energy field travelling along path A21 (on the left) drives the fibers of the first category through inlet 10 to be bombarded directly against a substantially perpendicular surface carrying teeth T3. This injection of the fibers directly against the surface, rather than generally tangentially to the surface and through the gaps between the teeth, causes a tremendous loss in fiber momentum and results in a much higher proportion of the long fibers, intermediate length fibers and even short fibers of the first category becoming entangled on teeth T3. These low kinetic energy fibers are immediately extracted through second outlet 20. Consequently, mainly dust and fine trashes flow on through the sorting channel SC and pass through first outlet 18. By directing the first energy field and fiber fog substantially against a nearly perpendicular surface causes the invention to behave like a condenser, rather than a high efficiency fiber sorter.

This action is considerably different from the action which occurs in sorting channel SC of the arrangements shown in FIGS. 1 and 2, where the fiber flow paths at the first inlet 10 are oriented to cause the fibers to pass between the teeth gaps and generally tangentially to the surface of the carrier.

For the sake of brevity, FIGS. 9 and 10 are intentionally drawn (compare these with FIGS. 1 and 2) to illustrate how the angular orientation of the channel 52, feeding the inlet 10 to the sorting channel, may be tilted to cause the invention to behave as a condenser, instead of a high efficiency fiber sorter device. However, it will be understood that the mechanism for doffing second category fibers off of the teeth T3 of the carriers shown in FIGS. 9 and 10 is applicable whether the invention is used either as a condenser, or a fiber sorter. Those skilled in the art will immediately visualize numerous ways how the feed channel approaching first inlet 10 can be made easily or quickly tiltable relative to the carrier surface via swiveling or flexible duct members. For example, referring now to FIG. 10', the energy field infeed channel 52 may be constructed with a generally cylindrically shaped end; which may be sandwiched or socketed between the top cover plate of the sorting channel, SC, and the infeed shoe piece. This provides a sealed pivot. Any suitable actuator 51 may be used to rotate infeed channel 52 about the resulting pivot axis and thereby orient the angle of incidence, or the flow direction of the fiber fog transported by the energy field, with respect to the surface of carrier 32. When actuator 51 is retracted, to hold infeed channel 52 generally horizontal (as shown with solid lines), the fog will flow along the path shown by arrow A21 (left) and will strike the surface of carrier 32 non-tangentially—which will cause the present invention to perform as a novel condenser. When actuator 51 is extended, the fog will follow the path shown by arrow A21' and thus pass generally tangentially over the surface of carrier 32—which will cause the present invention to perform as a novel fiber sorter.

Actuator 51 may be a simple mechanical link mechanism, which may be operated manually. Or, it could be a device that is responsive to remote control signals; such as a fluid actuated piston, servo-motor operated ball or worm screw jack, or the like. Using remote control signals, generated by well known type process controllers, to modulate the angle of incidence of the fiber fog upon the carrier surface (intermediate to the two extreme positions shown on FIG. 10')—and inputting either mass or short fiber content control signals from suitable sensors to the process controller—those skilled in the art will immediately appreciate that the present invention can be used to not only effectively sort fibers by length, but do so in an automatically controlled manner. Suitable process controllers and sensors which may be readily adapted to accomplish this advanced control function are taught, for example, by U.S. Pat. Nos. 4,275,483, 4,631,781, and 5,052,080.

Prior art condensers, are characterized by having at least one defined porous wall screen possessing both an inlet face and an outlet face through which the fiber conveying air enters and exits the wall, leaving the fibers deposited on the inlet face. The instant invention condenses the fibers from the air stream WITHOUT such defined faces.

The arrangements shown in FIGS. 2–10 have all used a first energy field to propel a fog of fibers through the sorting channel and to ply the fibers to the travelling teeth on a carrier surface in order to carry out the length-sorting/purifying/combing action. With the present invention it has been found that a combable beard may also be formed by mechanical or direct plying of the fibers of the first category of fibers to the teeth on a carrier surface.

Figure 11:
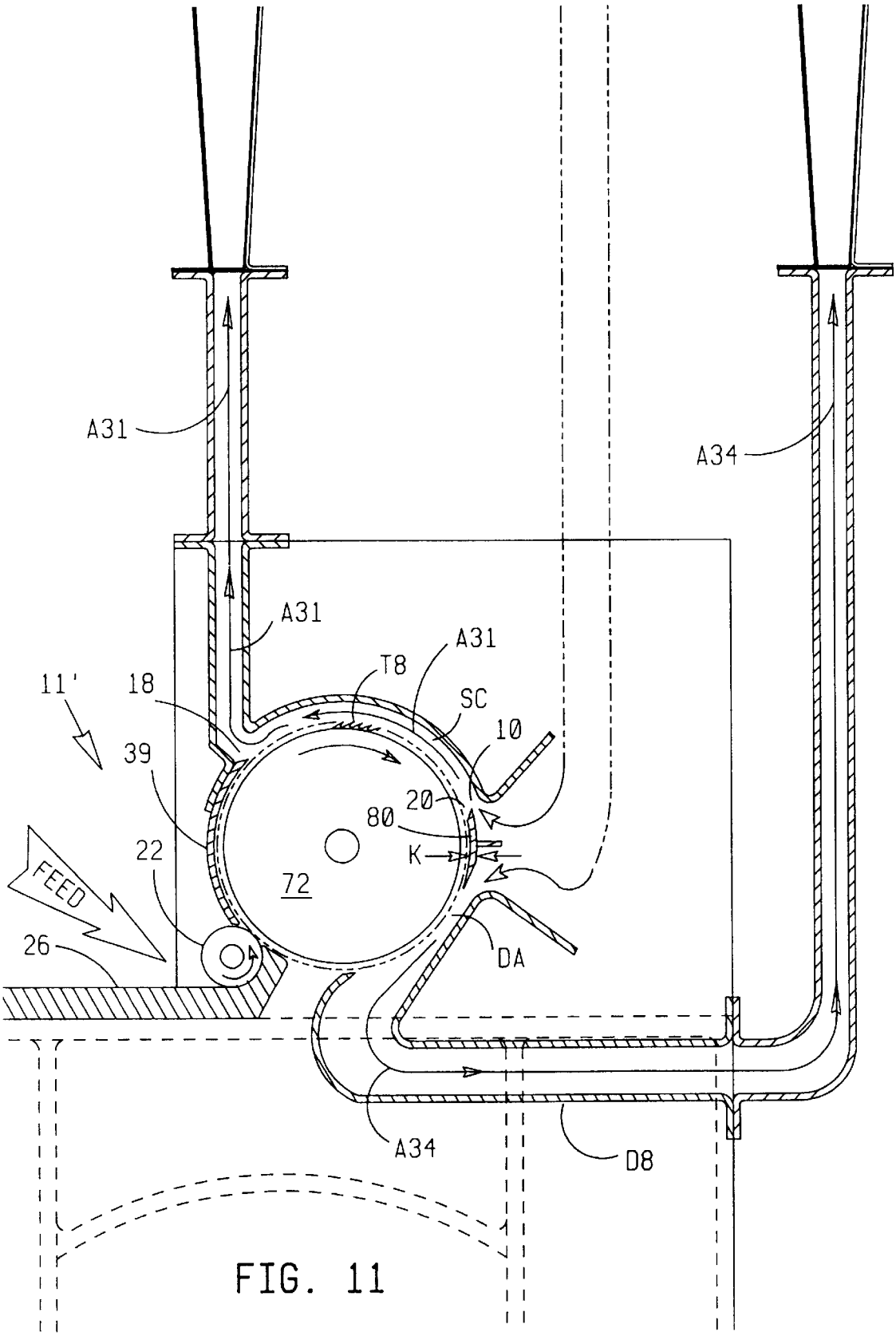
FIG. 11 is an enlarged diagrammatic sectional side view of yet another embodiment of the sorting and cleaning device according to the invention.
Figure 12:
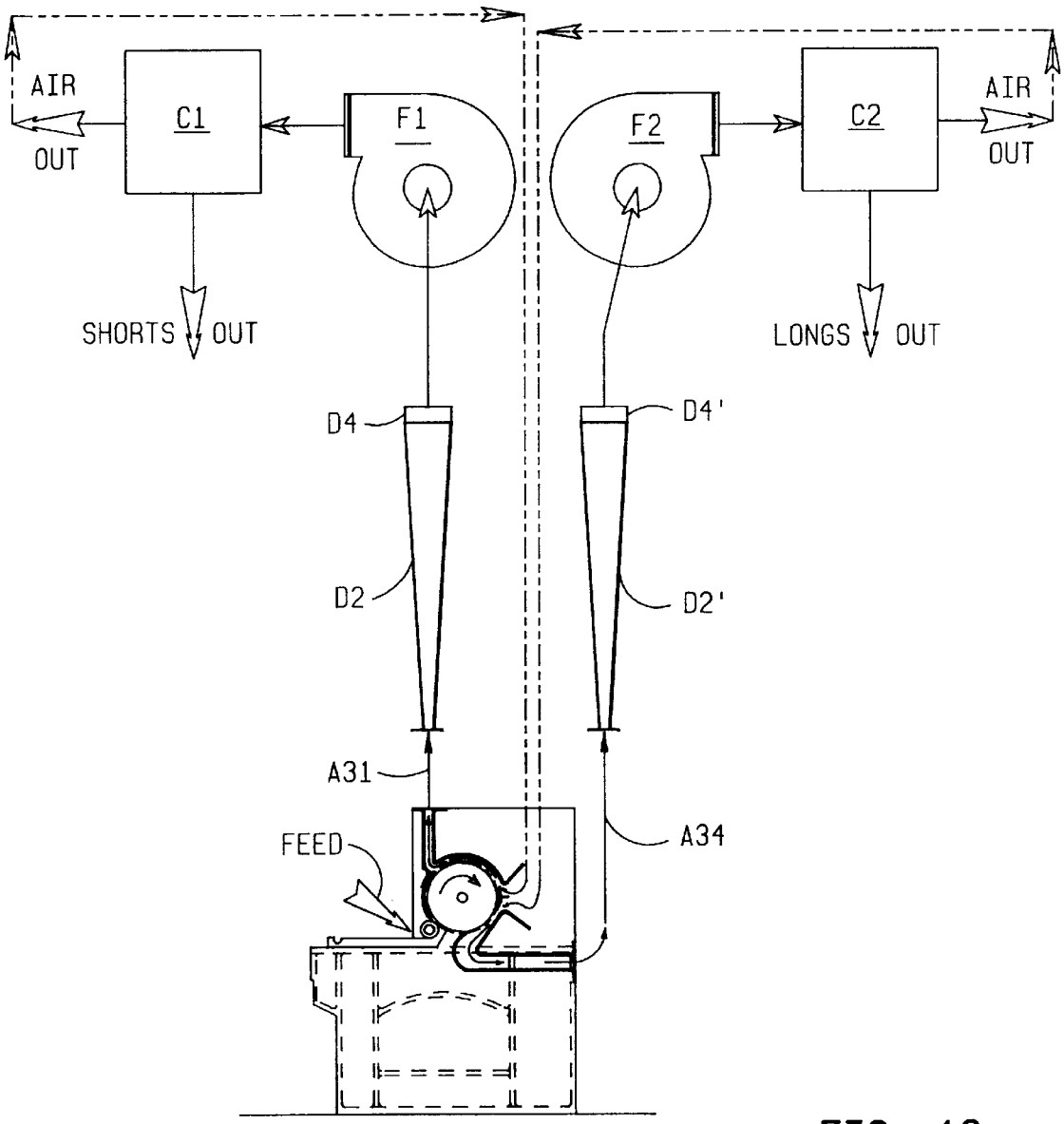
FIG. 12 is an overall system schematic for the device of FIG. 11.

Referring now to FIGS. 11 and 12 concurrently there is shown a fiber plying arrangement, comprising at least one feed roll 22 and a second cooperating nipping member shown here as feed plate 26, which plies fibers of the first category directly to teeth T8 of carrier cylinder 72 which is driven in a first direction indicated by the arrow.

Fan F1 creates a first energy field that enters a first inlet 10 just above the top end of control plate 80 and flows along a path, indicated by arrow A31, which is generally opposite to the travel direction of teeth T8. Fibers plied to teeth T8 by roll 22 are draped thereon by friction as they pass along the inner surface of plate 39 and enter the sorting channel SC. The free ends of the fibers engaged with teeth T8 are pointed in the direction of flow of the energy field as they exit the upper end of plate 39 and held latched by the energy field, presenting a beard of latched fibers suitable for air combing. The shorter fibers are aero-combed or stripped off the free ends of the latched longer fibers and are doffed along with dust and trash from the process through a first outlet 18 (as third category fibers) along the path traced by arrow A31. A second outlet 20 is located between the inner surface of control plate 80 and the body surface of cylinder 72 where the longer fibers (second category) remaining latched on teeth T8 pass for doffing. Doffing may be accomplished either by travelling teeth (similarly to the methods shown in FIGS. 9 and 10), or by a second energy field in the manner to be described.

A fan F2 may be used to create the second energy field which flows in at the bottom of control plate 80 along the path indicated by arrow A34, doffs the longer fibers off of teeth T8 in doffing area DA, and conveys them down and through a duct D8. These longer fibers are conveyed through duct D2' and finally removed from the second energy field at condenser C2.

In a manner similar to previous discussions, the sorted shorter length fibers and trash are transported by the first energy field through duct D2 and finally removed from the first energy field at condenser C1.

The pair of dash-dot-dot-dash lines, shown leaving the two condensers, illustrate how suitable piping may be used to return the two energy fields to the region of control plate 80; for recirculation and reduced energy consumption.

With the instant invention, it has been found that if the thickness dimension, K, of plate 80 is made at least one-fourth the mean length of the fibers under process, and if the plate is oriented as shown in FIG. 11 (with the keen point positioned closest to the teeth T8 and pointed in the direction of travel of the teeth T8) so that the other point at the top of the plate is disposed a distance K away from the tips of the teeth on the carrier (cylinder 72), then the fibers can be controlled against centrifugal forces and they will experience little "mote knife" effect. Those skilled in the art will immediately recognize that if extremely trashy fibers are to be processed, then control plate 80 can be mounted inverted (with the keen point up) and this will provide a "mote knife" effect. For most applications of the present invention, however, the preferred construction and orientation of plate 80 is as shown in FIG. 11.

Figure 13:
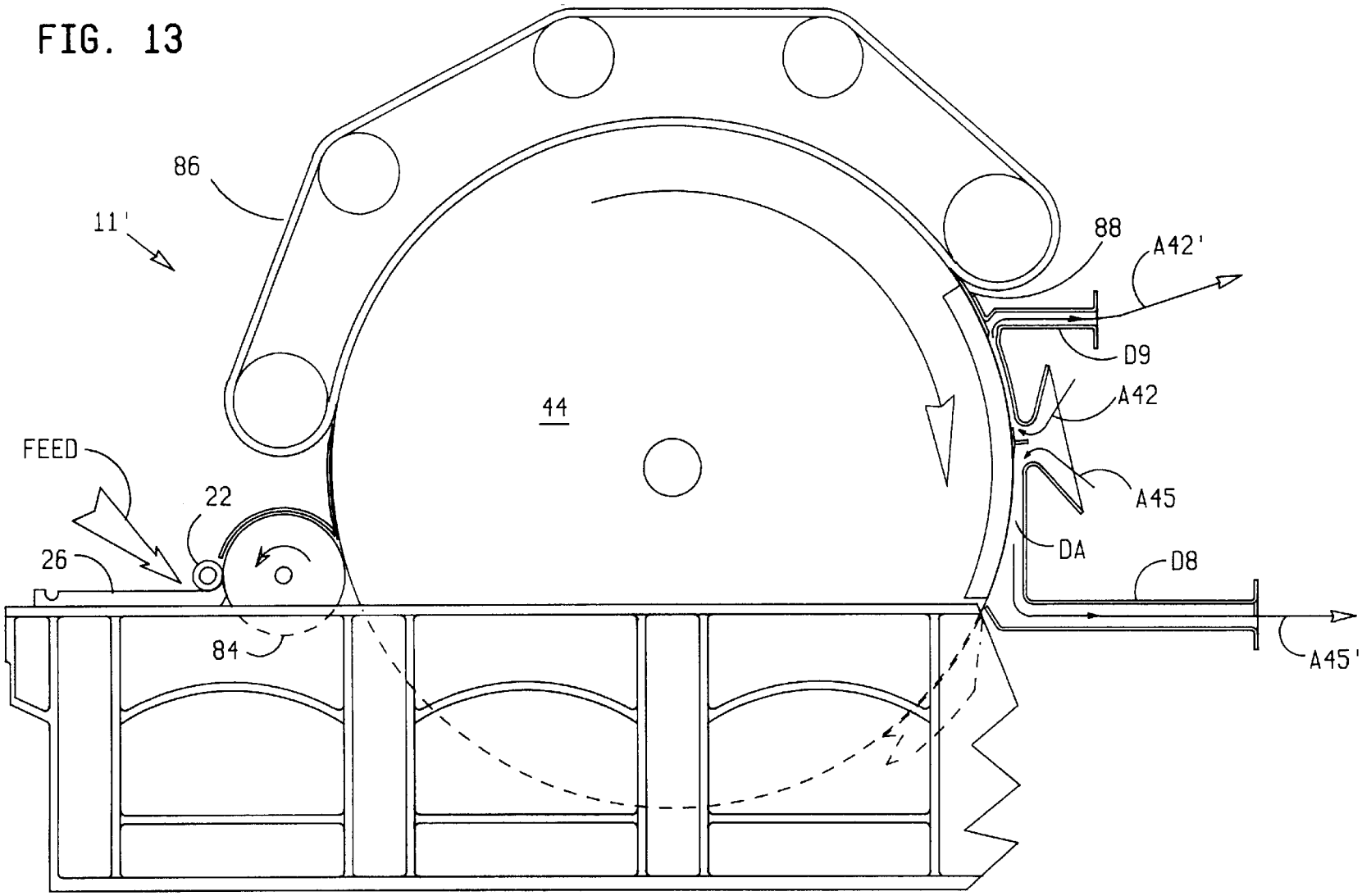
FIG. 13 is a diagrammatic sectional side view of a carding machine operating as an alternate opening device for the embodiment of the invention shown in FIG. 11.
Figure 14:
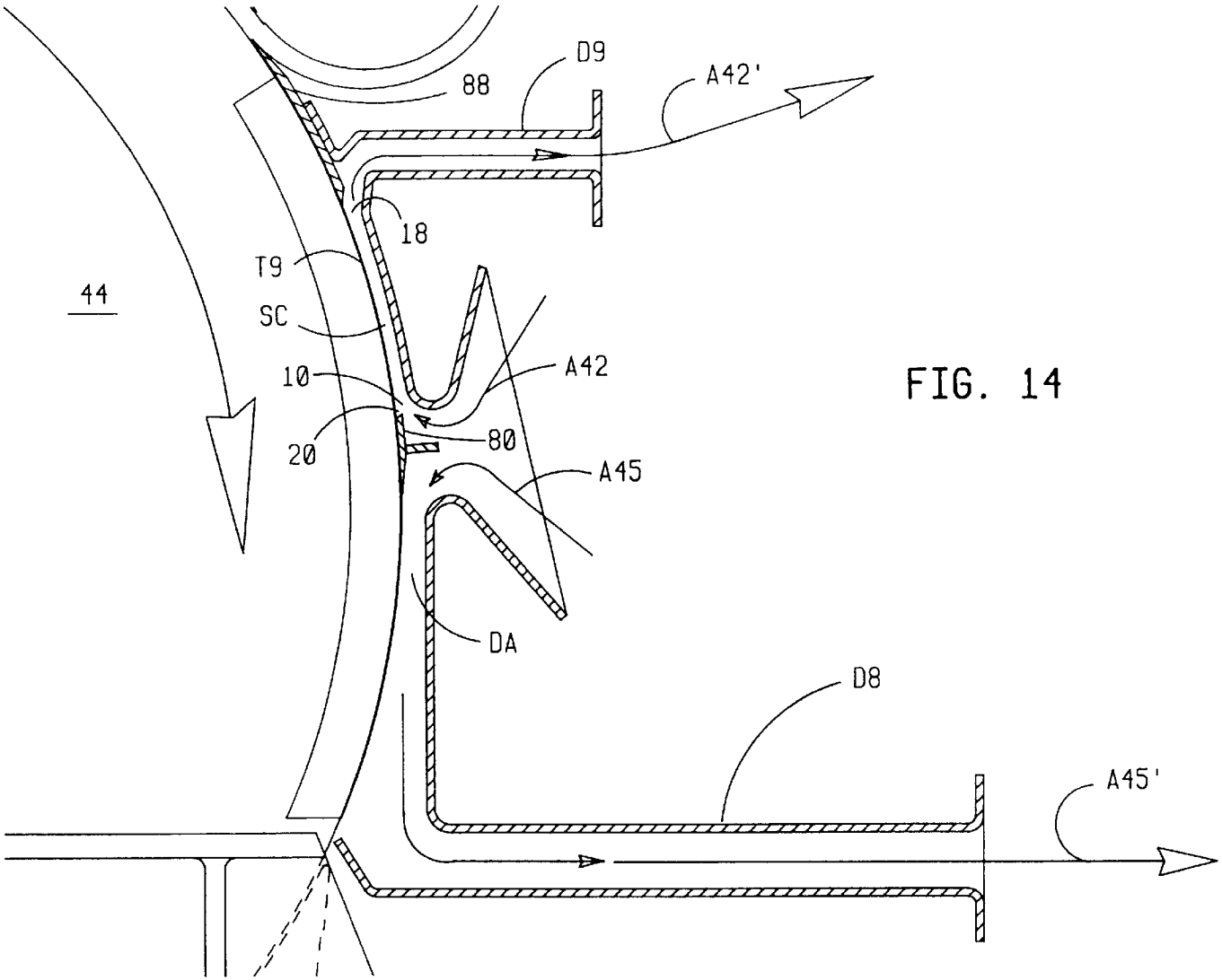
FIG. 14 is an enlarged view of the sorting and cleaning channel shown in FIG. 13.

Referring now to FIGS. 13 and 14 concurrently; it has been found that most of the major elements of a conventional carding machine can be utilized to do a superb job of fiber length-sorting and purifying. In this instance, the fibers are plied onto the nearly one million teeth disposed around the surface of main carding cylinder 44 which serve to carry the beard of draped fibers into the fiber sorting channel SC. The fiber feed includes a feed roll 22 and feed plate 26 which ply the fibers onto a licker-in cylinder 84 which is rotatively driven to act as a fiber plying device which plies the shredded fibers carried on its teeth (first category) onto the teeth T9 of cylinder 44. A very intense frictional effect is provided by the many thousands of teeth carried on the carding members 86, which are commonly referred to as "flats" when used as a travelling flexible apron or "segments" when used stationary. After the highly brushed beard of fibers draped on the teeth of cylinder 44 move from beneath upper front plate 88, the beard is aero-combed by an energy field shown entering through an inlet 10, along the path indicated by arrow 42, and flows along the path traced by arrow A42'. The energy field moves through the sorting channel, SC, in a direction opposite the direction of travel of cylinder 44 indicated by the arrow (on the cylinder). The shorter length-sorted fibers are stripped by the energy field as previously described and exit (as third category fibers) along the path indicated by arrow A42'. The longer length-sorted fibers (second category) remaining latched on teeth T9 are carried beneath control plate 80, as previously described, into doffing area DA where they may be doffed by a second energy field shown entering doffing area DA along the path indicated by arrow A45. These doffed (second category) fibers are thence moved through outlet duct D8—exiting along path indicated by arrow A45'.

Here, those skilled in the art will readily appreciate the fact that the state of the fibers flowing in either direction (ducts D8,D9) is a fog of fibers flowing in two-dimensional energy fields, and these fibers may be repeatedly length-sorted/purified again using methods previously described.

Plate 80 along with the energy fields function similarly to the arrangement described in FIGS. 11 and 12.

Figure 15:
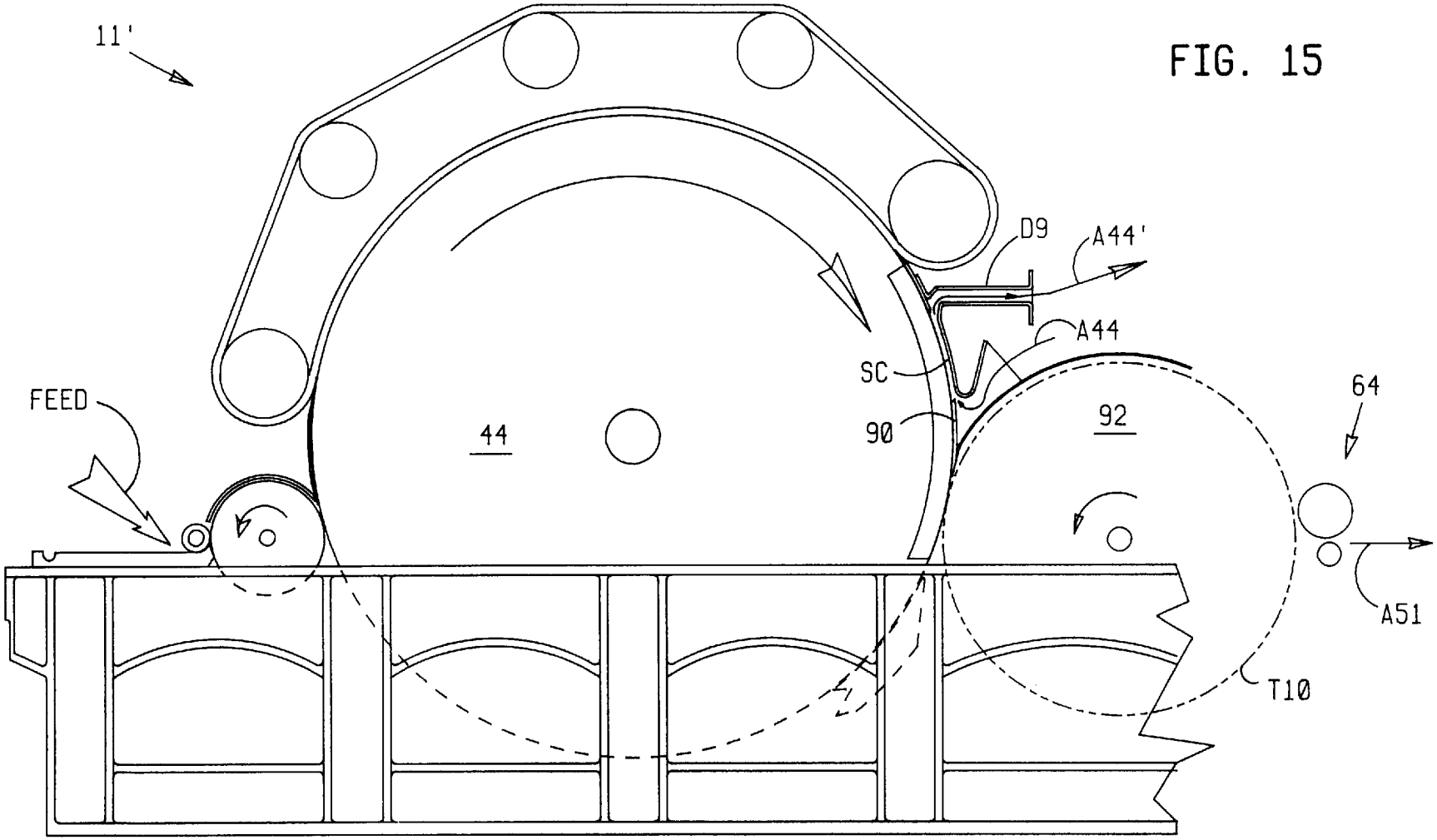
FIG. 15 is a diagrammatic sectional side view of another arrangement of a sorting and cleaning channel associated with a carding machine.
Figure 16:
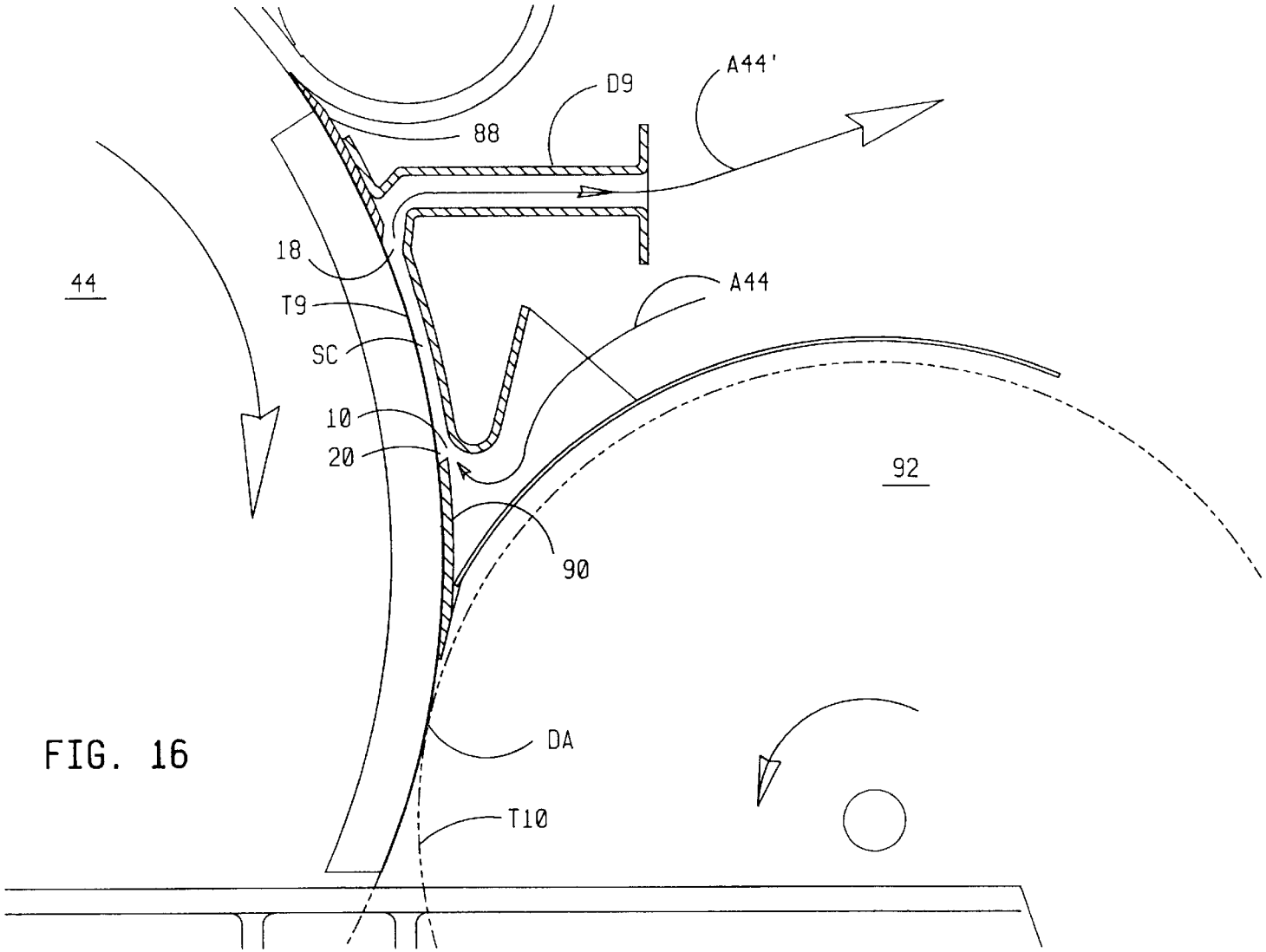
FIG. 16 is an enlarged view of a portion of the arrangement shown in FIG. 15.

Referring now to FIGS. 15 and 16, there is shown an similar arrangement to that shown in FIGS. 13 and 14. Here an alternative mechanical manner of doffing the longer length-sorted fibers is utilized. The aero-combing action is carried out in the sorting chamber SC as previously described, i.e. the shorter fibers and trash (third category) are washed from the longer fibers latched onto teeth T9 and carried by the energy field through duct D9 and exit in the direction of arrow A44'. However, in this arrangement, the longer (second category) fibers latched on teeth T9 are carried past a bottom control plate 90, and into engagement with the teeth T10 carried on doffer cylinder 92. As the latched longer fibers on teeth T9 of cylinder 44 encounter teeth T10 of cylinder 92, a thin web of fibers is deposited or built thereon. This web is stripped in a usual manner. Stripper 64 removes the web from T10 and the sorted longer fibers exit: along the path indicated by arrow A51.

The shorter length-sorted fibers (third category) flowing through first outlet 18 along the path shown by arrow A44' are in the state of a fog transported in the energy field and are suitable for additional processing in manners previously described.

While preferred embodiments of the invention have been described using specific terms, such description is for illustrative purposes only, and it is to be understood that changes and variations may be made without departing from the spirit or scope of the following claims.

What is claimed is:

1. An apparatus for sorting a first category of fibers having a first set of properties into at least a second category of fibers having a second set of properties and a third category of fibers having a third set of properties, said apparatus comprising:

a sorting channel including at least one travelling teeth laden carrier surface driven in a first direction within said sorting channel to provide travelling teeth which pass into, through and out of said sorting channel, said sorting channel further including at least a first inlet and at least first and second outlets;

an air propelling device producing a first energy field flowing through said sorting channel in a second direction generally opposite to said first direction;

said first energy field engaging said first category of fibers to hold at least longer fibers included with said first category of fibers latched onto said travelling teeth passing through said sorting channel, said latched at least longer fibers comprising fibers that have a mean length greater than the mean length of said first category of fibers, said first energy field concurrently washing, teasing, and stripping shorter fibers and impurities included with said first category of fibers away from said latched at least longer fibers, said latched at least longer fibers forming said second category of fibers and said stripped shorter fibers and impurities forming said third category of fibers, said first energy field further acting as a first doffer as said first energy field removes said third category of fibers from said sorting channel; and a second doffer for doffing said second category of fibers from said travelling teeth after said travelling teeth pass through said sorting channel.

2. The apparatus of claim 1 including at least one fiber plying device for plying said first category of fibers to said travelling teeth.

3. The apparatus of claim 1 including ducting communicating said sorting channel with said air propelling device, said ducting configured to cause said first energy field to exhibit generally two-dimensional flow characteristics within said sorting channel.

4. The apparatus of claim 1 including at least one second sorting channel also having travelling teeth, at least a first inlet and at least first and second outlets, said first inlet of said at least one second sorting channel communicating with a first outlet of a preceding sorting channel; whereby the third category of fibers produced in a preceding sorting channel may be sorted at least a second time.

5. The device of claim 4 wherein said second outlet of said at least one second sorting channel communicates with a fiber doffer.

6. The apparatus of claim 4 wherein said first outlet of said at least second sorting channel communicates with a condenser which further separates fibers, dust and trash from said first energy field.

7. The apparatus of claim 1 including at least one second sorting channel also having travelling teeth, at least a first inlet and at least first and second outlets, said first inlet of said at least one second sorting channel communicating with said second outlet of a preceding sorting channel; whereby the second category of fibers produced in a preceding sorting channel may be sorted at least a second time.

8. The apparatus of claim 1 including a fiber opening device which opens and plies said first category of fibers to said travelling teeth via direct mechanical transfer.

9. The apparatus of claim 1 including a fiber opening device which opens and plies said first category of fibers to said travelling teeth in the form of a fog of fibers.

10. The apparatus of claim 1 including a fiber opening device comprising a carding machine having a carding cylinder.

11. The device of claim 10 wherein said carding machine includes a doffing channel, said doffing channel being disposed adjacent a portion of the periphery of said carding cylinder.

12. The apparatus of claim 11 wherein said doffing channel communicates with said first inlet; whereby said first energy field is passed through the teeth of said carding cylinder doffing and transporting said first category of fibers into said first inlet.

13. The apparatus of claim 1 wherein said teeth laden carrier is comprised of a carding cylinder of a carding machine.

14. The apparatus of claim 1 including a fiber feed, said fiber feed including a fiber opening cylinder for opening said first category of fibers and a fiber doffer for doffing said first category of fibers from said opening cylinder.

15. The apparatus of claim 14 wherein said fiber doffer for doffing said first category of fibers from said opening cylinder includes said first energy field which removes said first category of fibers from said opening cylinder and plies said first category of fibers to said travelling teeth in the form of a fog of fibers.

16. The apparatus of claim 15 wherein said sorting channel includes a sorting area arranged adjacent that portion of said travelling teeth laden surface where said fog of fibers engage with said travelling teeth.

17. The apparatus of claim 1 wherein said second doffer includes a second energy field.

18. The apparatus of claim 1 wherein said travelling teeth laden surface comprises a carding cylinder of a carding machine and said second doffer comprises a doffer cylinder clothed with teeth for removing said second category of fibers from said carding cylinder.

19. The apparatus of claim 1 including a condenser communicating with said first outlet for intercepting impurities and short fibers transported with said first energy field.

20. The apparatus of claim 19 including transport ducting, said transport ducting communicating said condenser with said first inlet; whereby said first energy field may be reintroduced to said first inlet in a closed-loop or recirculating manner.

21. The apparatus of claim 1 wherein said second doffer includes teeth carried on a second travelling surface.

22. The apparatus of claim 1 including a feed channel communicating with said first inlet, said feed channel being oriented relative to said travelling carrier surface to cause said first category of fibers carried with said first energy field to strike said travelling carrier surface non-tangentially; whereby said second category of fibers passing through said second outlet is caused to be comprised primarily of both long and short fibers and said third category of fibers passing through said first outlet is caused to be comprised substantially of fiber fragments, dust, and trash particles.

23. The apparatus of claim 1 including a pivoted feed channel communicating with said first inlet; whereby said first category of fibers carried with said first energy field can be selectively oriented to strike said travelling carrier surface tangentially and non-tangentially.

24. The apparatus of claim 1 wherein said teeth have a projecting length from said carrier surface ranging between 1/32 inch (0.79 mm) and 1 inch (25.4 mm) and a surface density ranging between ½ tooth and 245 teeth per square inch (6.5 square cm).

25. The apparatus of claim 1 wherein said travelling carrier surface is driven at a surface speed ranging between 23 feet (7 meters) per minute and 6,900 feet (2,103 meters) per minute, said speed of said travelling carrier surface being primarily determined by the length and surface density of said teeth, the properties of said first category of fibers, and the preferred amount of said second category of fibers to be latched onto said travelling teeth.

26. The apparatus of claim 1 wherein said teeth are arranged over said driven carrier surface at an angle inclined toward said first direction within said sorting channel.

27. The apparatus of claim 1 wherein said teeth laden carrier surface is comprised of a belt.

28. The apparatus of claim 1 including a control plate arranged adjacent to the tips of a portion of said travelling teeth, said control plate having a first surface defining a portion of said first inlet and a second surface defining a portion of said second outlet.

29. The apparatus of claim 28 wherein said control plate has a thickness at least equal to one quarter of the mean length of the fibers comprising said first category of fibers.

30. A method of sorting fibers of a first category into at least second and third categories comprising;

driving a teeth laden carrier surface in a first direction through a sorting channel having at least a first inlet and at least first and second outlets, thereby providing travelling teeth passing into, through, and out of said sorting channel;

creating at least a first energy field and directing said first energy field to flow through said sorting channel in a second direction that is generally opposite to said first direction;

plying said first category of fibers to said travelling teeth;

using said first energy field to hold at least longer length fibers included with said first category of fibers latched onto said travelling teeth within said sorting channel, producing said second category of fibers;

concurrently using said first energy field within said sorting channel for washing, teasing, and stripping shorter length fibers and impurities included with said first category of fibers away from said latched second category of fibers, producing said third category of fibers;

further using said first energy field to remove said third category of fibers from said sorting channel; and doffing said second category of fibers from said travelling teeth after said travelling teeth pass through said sorting channel.

31. The method of claim 30 including generating a fog of fibers of said first category for plying said first category of fibers to said travelling teeth.

32. The method of claim 30 including opening said first category of fibers and mechanically transferring said first category of fibers to said travelling teeth.

33. The method of claim 30 including carding said first category of fibers prior to introducing said first category of fibers to said first energy field.

34. The method of claim 30 including passing said third category of fibers through said first outlet and into a succeeding sorting channel having travelling teeth.

35. The method of claim 30 including passing said second category fibers through said second outlet and into a succeeding sorting channel having travelling teeth.

36. The method of claim 30 including creating a second energy field for doffing said second of category fibers from said travelling teeth.

37. The method of claim 36 including communicating at least said second energy field back to said travelling teeth in a closed-loop or recirculating manner.

38. The method of claim 30 including communicating at least said first energy field from said first outlet back to said first inlet in a closed-loop or recirculating manner.

39. The method of claim 30 including providing a feed channel communicating with said first inlet and orienting said feed channel to cause said first category of fibers to strike said driven carrier surface non-tangentially, thereby causing said second category of fibers passing through said second outlet to be comprised of both longer and shorter fibers of said first category of fibers and said third category of fibers passing through said first outlet to be comprised primarily of dust, trash, and fiber fragments.

40. The method of claim 30 including inducing said first energy field to exhibit generally two-dimensional flow characteristics while passing through said sorting channel.

41. An apparatus for cleaning and sorting fibers into factions having designated properties comprising:

a cleaning and sorting channel including a carrier rotatively driven in a first direction through said cleaning and sorting channel, said carrier having teeth arranged over its outer surface, said cleaning and sorting channel further including a sorting area communicating with an inlet channel and at least an outlet channel, said inlet and said outlet channels being arranged on generally opposite sides of said carrier;

an air propelling device producing a first energy field;

said first energy field passing in a second direction generally opposite to said first direction through said inlet channel, said sorting area and said outlet channel;

a fiber feed operative to deliver dust, impurities and separated fibers of various lengths into said inlet channel to be engaged by said first energy field;

a doffer arranged adjacent said carrier outside of said cleaning and sorting channel; whereby, said various length fibers, dust and impurities fed from said fiber feed device and engaged by said first energy field are carried through said inlet channel and propelled onto said teeth of said carrier with said first energy field continuing to pass over said carrier and out through said outlet channel with at least certain fibers of said propelled fibers engaging with and being latched onto said teeth while at least said dust and impurities are carried out through said outlet channel by said first energy field while said carrier moves said engaged certain fibers to said doffer where said doffer doffs said certain fibers from said teeth.

42. The device of claim 41 wherein said carrier comprises a cylinder and said inlet channel is aligned to deliver said fibers, dust and impurities non-tangentially to said cylinder causing substantially all of said fibers to be latched on said teeth.

43. The device of claim 41 wherein said carrier comprises a cylinder and said inlet channel is aligned to deliver said fibers, dust and impurities generally tangentially to said cylinder causing primarily the longer length fibers of said fibers to be latched on said teeth.

44. The device of claim 41 wherein said doffer comprises a doffing cylinder which mechanically removes said latched fibers from said teeth.

45. Apparatus for cleaning and sorting fibers into factions including;

a cleaning and sorting channel comprising a housing, an endless support rotating in a first direction having teeth arranged over its outer surface, an intake and a first and second outlet;

a fiber feed connected with said intake, said fiber feed being operative to feed fibers into said intake;

an air guide directing a stream of air over at least a portion of said outer surface;

a control plate associated with said air guide for dividing said stream of air into at least first and second air streams, said first air stream passing over a portion of said outer surface in said first direction and said second air stream passing over a second portion of said outer surface in a second direction whereby, said intake delivers fibers from said fiber fed onto said rotating teeth where said fibers are latched with said teeth of said support, said support operating to sequentially carry said fibers through first said second air stream which acts to separate dust impurities and certain fibers from said teeth and through said first air stream which acts to doff said latched other fibers from said teeth.

46. The device of claim 45 wherein said fiber feed includes a nipper plate and a feed roll, said fiber feed operating to deliver a web of opened fibers into said intake.

47. The device of claim 45 wherein said intake includes a fiber latching area in which a latching plate integrates said fiber web onto said teeth.

48. The device of claim 45 including a sorting channel in which said second air stream separates said dust, trash, and short fibers from longer fibers and latches said longer fiber onto said teeth, said first outlet connecting with a first end of said sorting channel to remove from said channel said second air stream carrying said dust, impurities and certain short fibers.

49. The device of claim 45 wherein said control plate acts to deliver said second air stream to said sorting channel from a second end located opposite said first end.

50. The device of claim 45 including mounting means mounting said control plate for adjustment relative said housing and said air guide, whereby the volume of said first and second air streams passing over said support surface may be adjusted.

* * * * *